US011658433B2

(12) United States Patent
Komoto

(10) Patent No.: US 11,658,433 B2
(45) Date of Patent: May 23, 2023

(54) CONNECTOR

(71) Applicant: Japan Aviation Electronics Industry, Limited, Tokyo (JP)

(72) Inventor: Tetsuya Komoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 85 days.

(21) Appl. No.: 17/407,745

(22) Filed: Aug. 20, 2021

(65) Prior Publication Data

US 2022/0158373 A1 May 19, 2022

(30) Foreign Application Priority Data

Nov. 18, 2020 (JP) ..... JP2020-191604

(51) Int. Cl.
*H01R 12/77* (2011.01)
*H01R 13/502* (2006.01)

(52) U.S. Cl.
CPC ..... *H01R 12/778* (2013.01); *H01R 13/502* (2013.01)

(58) Field of Classification Search
CPC ..... H01R 12/778; H01R 13/502; H01R 4/50; H01R 12/7011; H01R 13/41; H01R 12/65; H01R 12/592; H01R 13/2407; H01R 13/02
See application file for complete search history.

(56) References Cited

U.S. PATENT DOCUMENTS

| | | | | |
|---|---|---|---|---|
| 10,868,380 | B1 * | 12/2020 | Komoto | H01R 13/73 |
| 10,886,650 | B1 * | 1/2021 | Komoto | H01R 12/771 |
| 2019/0148901 | A1 | 5/2019 | Komoto | |
| 2022/0158373 | A1 * | 5/2022 | Komoto | H01R 12/592 |
| 2022/0302617 | A1 * | 9/2022 | Komoto | H01R 12/592 |

FOREIGN PATENT DOCUMENTS

| | | | | |
|---|---|---|---|---|
| EP | 3 376 601 | A | 9/2018 | |
| EP | 3739689 | A1 * | 11/2020 | H01R 12/592 |
| JP | 201987515 | A | 6/2019 | |

* cited by examiner

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A connector includes a first insulator, a second insulator and at least one contact, the contact being composed of a first contact member retained by the first insulator and a second contact member retained by the second insulator, the first contact member including a first connection portion and a first communication portion, the second contact member including a second connection portion and a second communication portion, a connection object being sandwiched between the first connection portion and the second connection portion, the first communication portion and the second communication portion being in elastic contact with each other via an elastic piece, and at least one of the first connection portion and the second connection portion coming into contact with a flexible conductor of the connection object, whereby the contact is electrically connected to the flexible conductor of the connection object.

10 Claims, 19 Drawing Sheets

CONNECTOR

BACKGROUND OF THE INVENTION

The present invention relates to a connector, particularly to a connector attached to a connection object having a flexible conductor exposed on at least one of surfaces of the connection object.

As a connector attached to a connection object having a flexible conductor, for instance, JP 2019-87515 A discloses a connector 1 shown in FIG. 46. The connector 1 has a structure in which a connection object 4 is sandwiched and held between a first insulating member 2 of flat plate shape and a second insulating member 3 of frame shape having an opening 3A in its center.

In the first insulating member 2, there are formed convex portions 2A projecting in the opening 3A of the second insulating member 3 and projections 2B projecting toward the second insulating member 3 at positions closer to the lateral edge portions of the first insulating member 2 than the convex portions 2A are. Contacts 5 are retained by the first insulating member 2 to be exposed on surfaces of the convex portions 2A and the projections 28. Projection accommodating portions 3B of recess shape for accommodating the projections 2B of the first insulating member 2 are formed at the surface of the second insulating member 3 that faces the first insulating member 2.

The connection object 4 has a flexible conductor 6 exposed on the bottom surface of the connection object 4, i.e., the surface facing the first insulating member 2. When the first insulating member 2 and the second insulating member 3 are pushed to approach each other in the state where the connection object 4 is disposed between the first and second insulating members 2 and 3, as shown in FIG. 47, the connection object 4 is inserted into the projection accommodating portion 3B of the second insulating member 3 by the projection 2B of the first insulating member 2. Consequently, the connection object 4 is sandwiched between the inner surface of the projection accommodating portion 3B and a part of the contact 5 disposed on the surface of the projection 2B of the first insulating member 2, so that the contact 5 is electrically connected to the flexible conductor 6 exposed on the bottom surface of the connection object 4.

Meanwhile, another part of the contact 5 that is situated on the surface of the convex portion 2A of the first insulating member 2 makes contact with and is electrically connected to the corresponding contact of a counter connector when a part of the counter connector is inserted into the opening 3A of the second insulating member 3 and the counter connector is fitted to the connector 1.

Thus, the use of the connector 1 of JP 2019-87515 A makes it possible to electrically connect the contact 5 to the flexible conductor 6 exposed on the bottom surface of the connection object 4.

However, since the bottom surface of the connection object 4 makes contact with the contact 5 in the projection accommodating portion 3B of the second insulating member 3, in the case where the flexible conductor 6 is exposed not on the bottom surface but only on the top surface of the connection object 4, the contact 5 cannot be electrically connected to the flexible conductor 6.

SUMMARY OF THE INVENTION

The present invention has been made to solve the foregoing problem and aims at providing a connector that enables to make an electrical connection of a contact to a flexible conductor of a connection object regardless of whether the flexible conductor is exposed on the top surface or the bottom surface of the connection object.

A connector according to the present invention is one attached to a connection object having a flexible conductor exposed on at least one of surfaces of the connection object, the connector comprising:

a first insulator;

a second insulator assembled to the first insulator in a predetermined assembling direction, and at least one contact made of a conductive material, wherein the contact is composed of a first contact member retained by the first insulator and a second contact member retained by the second insulator, the first contact member includes a contact portion that makes contact with a contact of a counter connector, a first connection portion that makes contact with one of the surfaces of the connection object, and a first communication portion connected to the second contact member, the second contact member includes a second connection portion that makes contact with the other of the surfaces of the connection object, and a second communication portion facing the first communication portion and connected to the first contact member, the connection object is sandwiched between the first connection portion and the second connection portion, one of the first communication portion and the second communication portion includes an elastic piece protruding to the other of the first communication portion and the second communication portion, the first communication portion and the second communication portion are in elastic contact with and thereby electrically connected to each other via the elastic piece at a position different from a place where the connection object is sandwiched between the first connection portion and the second connection portion, and at least one of the first connection portion and the second connection portion makes contact with the flexible conductor of the connection object, whereby the contact is electrically connected to the flexible conductor of the connection object.

DETAILED DESCRIPTION OF THE INVENTION

Embodiments of the present invention are described below with reference to the accompanying drawings.

Embodiment 1

Figure 1:
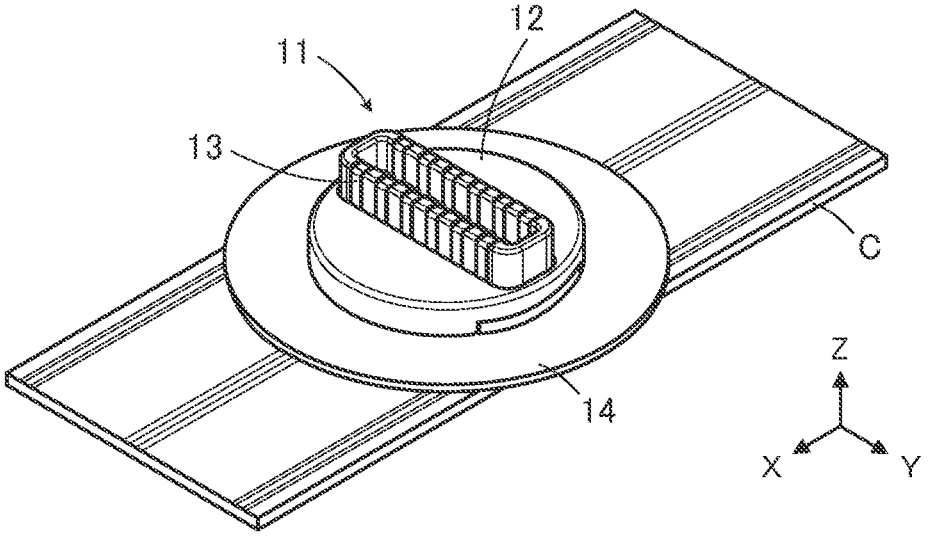
FIG. 1 is a perspective view of a connector according to Embodiment 1 attached to a connection object, as viewed from an obliquely upper position.
Figure 2:
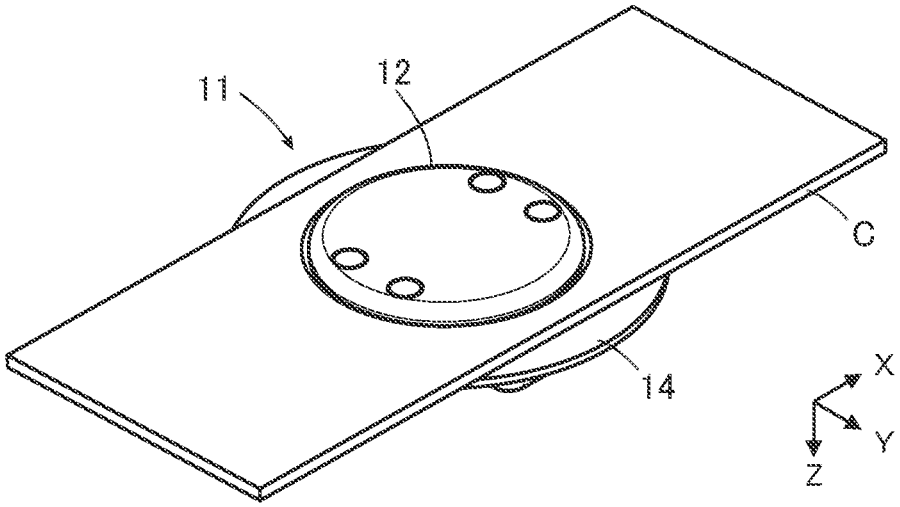
FIG. 2 is a perspective view of the connector according to Embodiment 1 attached to the connection object, as viewed from an obliquely lower position.
Figure 3:
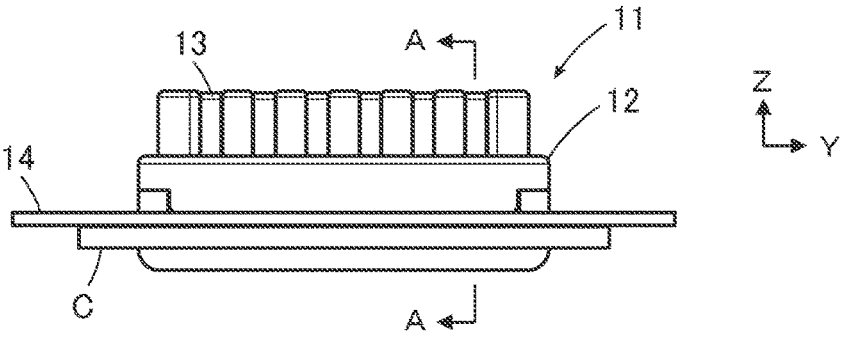
FIG. 3 is a front view of the connector according to Embodiment 1 attached to the connection object.

FIGS. 1 to 3 show a connector 11 according to Embodiment 1. The connector 11 is attached to, for example, a connection object C such as a garment and used as a connector fox fitting a wearable device. The connector 11 includes a connector body 12 made of an insulating material. In the connector body 12, a plurality of contacts 13 are retained to project perpendicularly to the connection object C in two lines parallel to each other.

The connector 11 is attached to the connection object C along with a tab sheet 14 for reinforcing the connection object C.

For convenience, the connection object C is defined as extending along an XY plane, the direction in which the contacts 13 are aligned is referred to as "Y direction," and the direction in which the contacts 13 project is referred to as "+Z direction."

Figure 4:
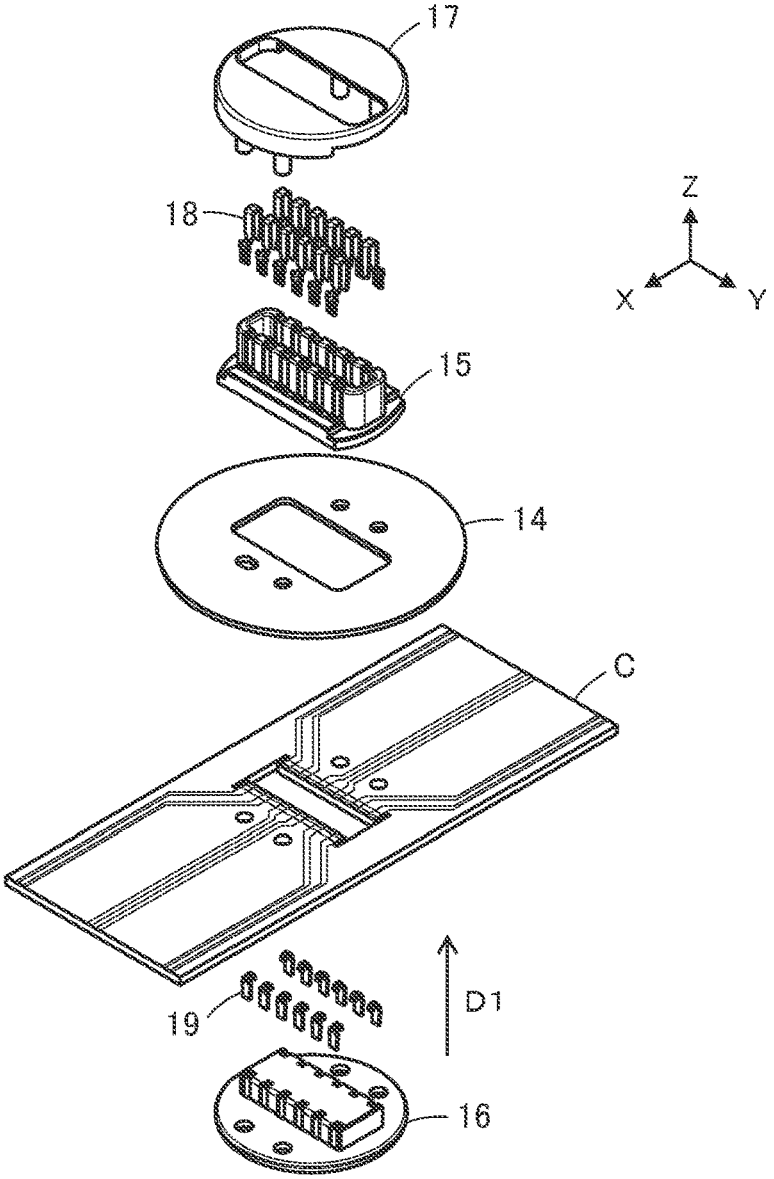
FIG. 4 is an exploded perspective view of the connector according to Embodiment 1.

FIG. 4 is an exploded perspective view of the connector 11. The connector 11 includes a first insulator 15, a second insulator 16 and a third insulator 17, and these first insulator 15, second insulator 16 and third insulator 17 constitute the connector body 12.

Each of the contacts 13 is composed of a first contact member 18 and a second contact member 19. The first contact members 18 of the plurality of contacts 13 are retained by the first insulator 15, and the second contact members 19 of the plurality of contacts 13 are retained by the second insulator 16.

With the second insulator 16 and the first insulator 15 sandwiching the connection object C and the tab sheet 14, the second insulator 16 by which the second contact members 19 of the contacts 13 are retained is assembled to the first insulator 15 by which the first contact members 18 of the contacts 13 are retained, in the +Z direction which is a predetermined assembling direction D1. The third insulator 17 is configured to fix the second insulator 16 to the first insulator 15.

Figure 5:
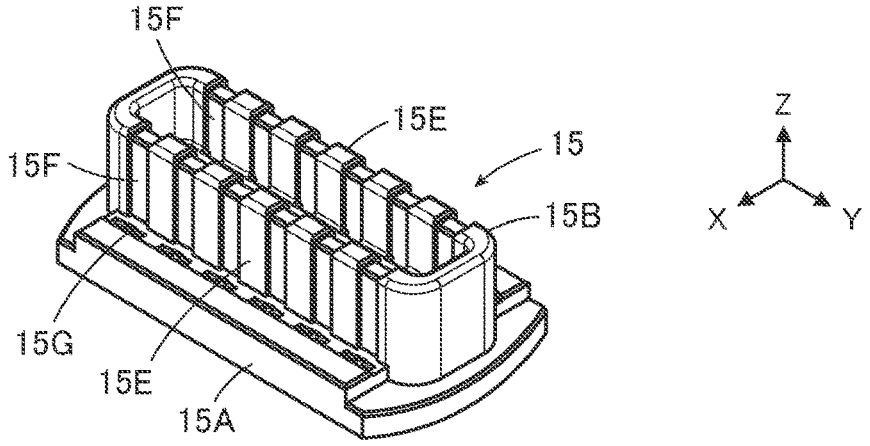
FIG. 5 is a perspective view of a first insulator used in the connector according to Embodiment 1, as viewed from an obliquely upper position.
Figure 6:
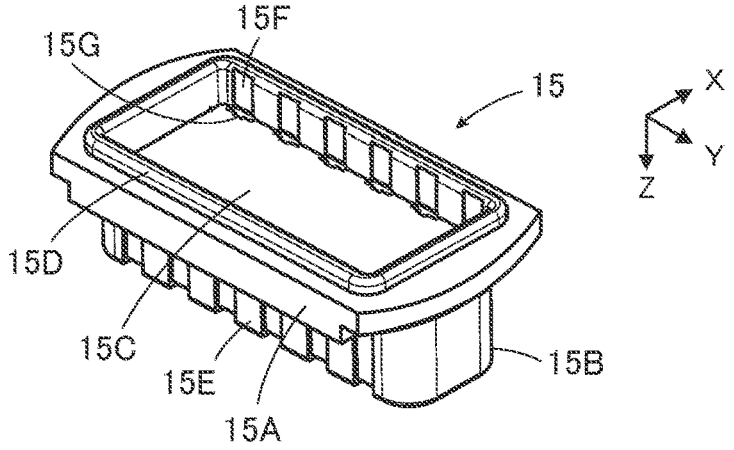
FIG. 6 is a perspective view of the first insulator used in the connector according to Embodiment 1, as viewed from an obliquely lower position.

As shown in FIGS. 5 and 6, the first insulator 15 includes a base portion 15A of flat plate shape extending along the XY plane and a protruding portion 158 of frame shape situated in the center of the base portion 15A and protruding in the +Z direction from the base portion 15A. The base portion 15A and the protruding portion 15B each have a substantially rectangular outer shape with long sides extending in the Y direction and short sides extending in the X direction when viewed in the Z direction.

At a surface on the −Z direction side of the base portion 15A, a recessed portion 15C opening in the −Z direction is formed, and a protruding portion 15D protruding in the −Z direction is formed along the periphery of the recessed portion 15C. The protruding portion 15B of frame shape includes a pair of long side portions 15E facing each other in the X direction and extending in the Y direction, and a plurality of retaining grooves 15F extending in the Z direction and used to retain the first contact members 18 are formed at an outer surface and an inner surface of each of the long side portions 15E.

The base portion 15A is provided with a plurality of through-holes 15G separately corresponding to the plurality of retaining grooves 15F and penetrating from a surface on the +Z direction side of the base portion 15A through the recessed portion 15C. Although not shown in FIG. 5, a plurality of insertion holes separately connected to the plurality of retaining grooves 15F are formed to extend in the −Z direction in the base portion 15A in the region surrounded by the protruding portion 15B of frame shape.

Figure 7:
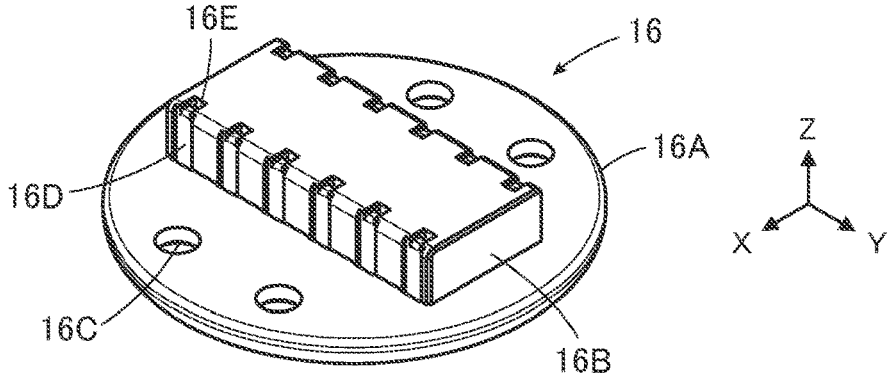
FIG. 7 is a perspective view of a second insulator used in the connector according to Embodiment 1, as viewed from an obliquely upper position.
Figure 8:
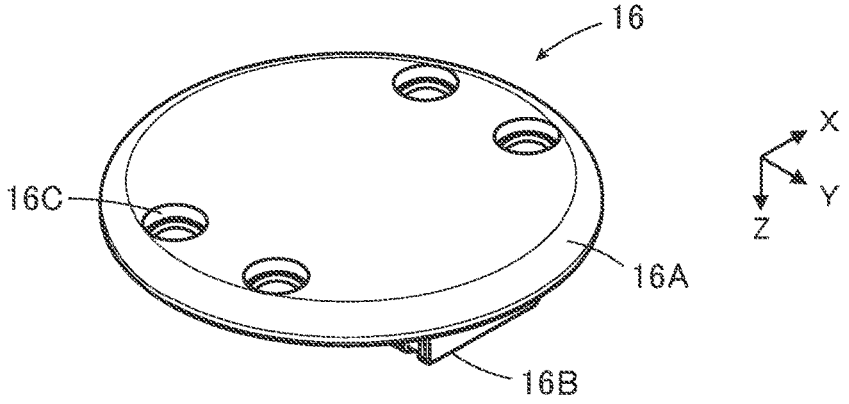
FIG. 8 is a perspective view of the second insulator used in the connector according to Embodiment 1, as viewed from an obliquely lower position.

As shown in FIGS. 7 and 8, the second insulator 16 includes a base portion 16A of circular disk shape extending along the XY plane and a projection portion 16B of cuboid shape situated in the center of the base portion 16A and projecting in the +2 direction from the base portion 16A.

When the second insulator 16 is assembled to the first insulator 15, the projection portion 16B is inserted into the recessed portion 15C of the first insulator 15. The projection portion 16B has a size slightly smaller than that of the recessed portion 15C in the XY plane.

The base portion 16A is provided with a plurality of through-holes 16C arranged on each of opposite sides in the X direction of the projection portion 16B and penetrating the base portion 16A in the Z direction. The projection portion 16B has a rectangular outer shape with long sides extending in the Y direction and short sides extending in the X direction when viewed in the Z direction, and a plurality of retaining grooves 16D extending in the Z direction and used to retain the second contact members 19 are formed at each of lateral surfaces of long side portions of the projection portion 16B.

Further, at an upper surface, which faces in the +Z direction, of the projection portion 16B, a plurality of insertion holes 16E separately corresponding to the plurality of retaining grooves 16D are formed in the −Z direction.

Figure 9:
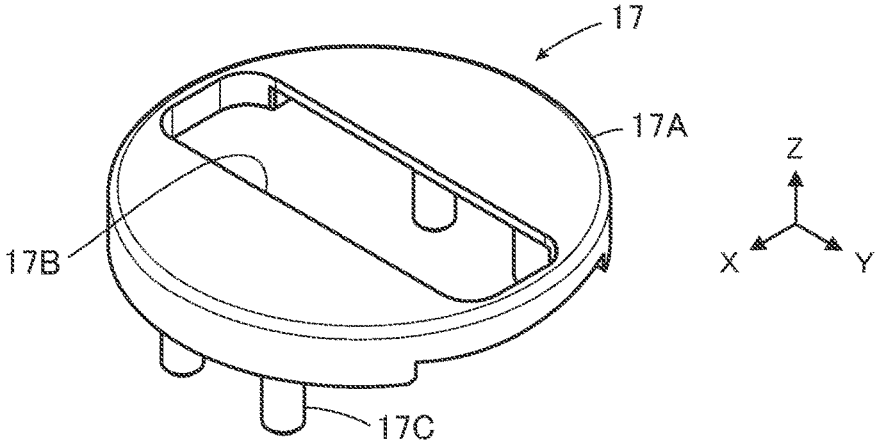
FIG. 9 is a perspective view of a third insulator used in the connector according to Embodiment 1, as viewed from an obliquely upper position.
Figure 10:
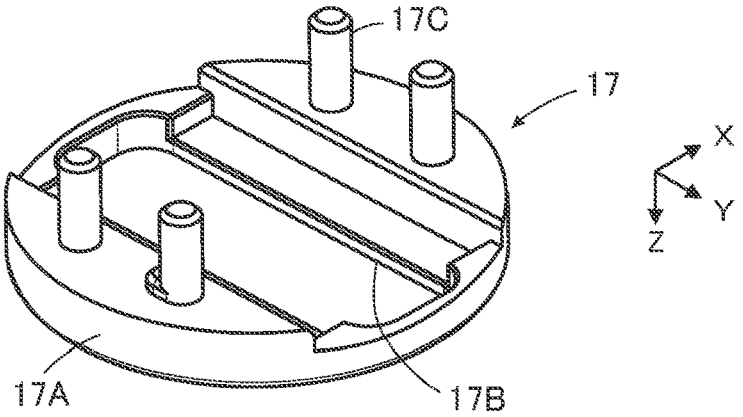
FIG. 10 is a perspective view of the third insulator used in the connector according to Embodiment 1, as viewed from an obliquely lower position.

As shown in FIGS. 9 and 10, the third insulator 17 includes a base portion 17A of circular disk shape extending along the XY plane. The base portion 17A of the third insulator 17 and the base portion 16A of the second insulator 16 have the substantially same size as each other in the XY plane.

A substantially rectangular opening portion 17B with long sides extending in the Y direction and short sides extending in the X direction is formed in the middle of the base portion 17A. The opening portion 17B is provided to receive the protruding portion 15B of the first insulator 15 retaining the plurality of first contact members 18 and has a size slightly larger than that of the protruding portion 15B in the XY plane.

A plurality of fixing posts 17C projecting in the −Z direction are formed at a surface on the −Z direction side of the base portion 17A on each of opposite sides in the X direction of the opening portion 17B. The fixing posts 17C separately correspond to the plurality of through-holes 16C of the second insulator 16, and each of the fixing posts 17C is passed through the corresponding through-hole 16C of the second insulator 16 assembled to the first insulator 15.

Figure 11:
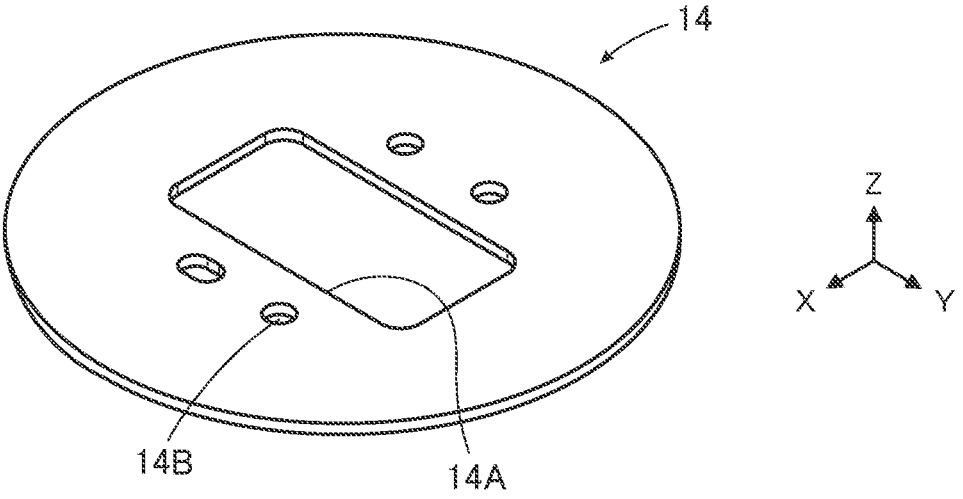
FIG. 11 is a perspective view of a tab sheet used in the connector according to Embodiment 1.

As shown in FIG. 11, the tab sheet 14 is configured to reinforce the connection object C to which the connector 11 is attached, is made of an insulating material such as resin or cloth, and has a size larger than that of the base portion 15A of the first insulator 15 and that of the base portion 17A of the third insulator 17 in the XY plane.

A substantially rectangular opening portion 14A with long sides extending in the Y direction and short sides extending in the X direction is formed in the middle of the tab sheet 14. When the connector 11 is attached to the connection object C, a portion of the tab sheet 14 around the opening portion 14A is, together with the connection object C, sandwiched between the base portion 16A of the second insulator 16 and the base portion 17A of the third insulator 17, and at this time, the protruding portion 15D along the periphery of the recessed portion 15C at the surface on the −Z direction side of the base portion 15A of the first insulator 15 is inserted into the opening portion 14A.

A plurality of through-holes 14B are formed at each of opposite sides in the X direction of the opening portion 14A of the tab sheet 14. The through-holes 14B separately correspond to the plurality of fixing posts 17C of the third insulator 17, and the fixing posts 17C separately penetrate the through-holes 148.

Figure 12:
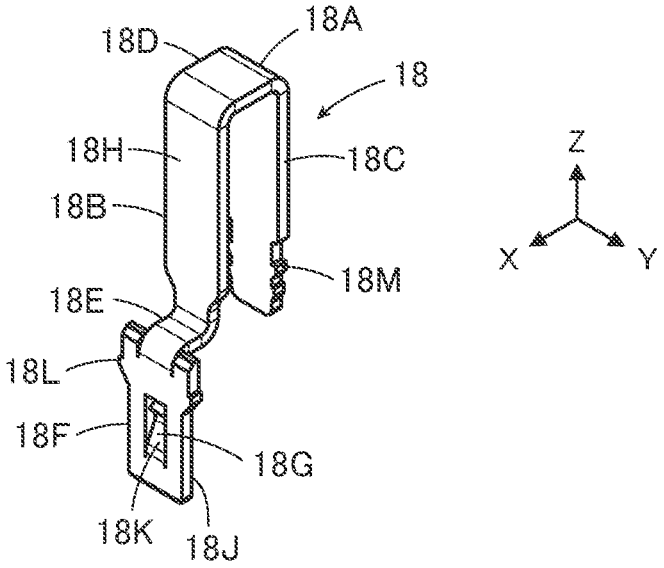
FIG. 12 is a perspective view of a first contact member used in the connector according to Embodiment 1, as viewed from an obliquely upper position.
Figure 13:
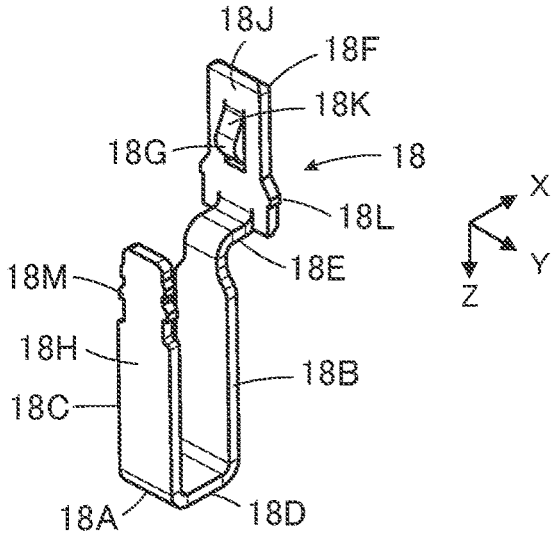
FIG. 13 is a perspective view of the first contact member used in the connector according to Embodiment 1, as viewed from an obliquely lower position.

FIGS. 12 and 13 show the configuration of the first contact member 18 retained in the retaining groove 15F of the long side portion 15E situated on the +X direction side of the pair of long side portions 15E of the protruding portion 15B of the first insulator 15 shown in FIG. 5.

The first contact member 18 is composed of a strip-like member made of a conductive material such as metal and includes a U-shaped portion 18A bent in a U shape. The U-shaped portion 18A is composed of a pair of extending portions 18B and 18C extending along a YZ plane and facing each other in the X direction and a joint portion 18D that joins +Z directional ends of the pair of extending portions 18B and 18C to each other. A flat plate portion 18F extending along a YZ plane is connected via a step portion 18*a* to a −Z directional end of the extending portion 18B, and an elastic piece 18G protruding in the −X direction is formed in the middle of the flat plate portion 18F.

An outer surface of the U-shaped portion 18A forms a contact portion 18H that makes contact with a contact of a counter connector, a surface on the −X direction side of a −Z directional end of the flat plate portion 18F forms a first connection portion 18J that makes contact with a top surface of the connection object C, and the elastic piece 18G forms a first communication portion 18K to be connected to the second contact member 19. In other words, the first connection portion 18J and the first communication portion 18K are arranged side by side in the Z direction.

A +Z directional end of the flat plate portion 18F and a −Z directional end of the extending portion 19C are respectively provided with press-fitted portions 18L and 18M protruding in a width direction of the strip-like member, i.e., the Y direction.

Meanwhile, the first contact member 18 retained in the retaining groove 15F of the long side portion 15E situated on the −X direction side of the pair of long side portions 15E of the protruding portion 15B of the first insulator 15 shown in FIG. 5 has the same configuration as that of the first contact member 18 shown in FIGS. 12 and 13 but is disposed in an opposite orientation therefrom in the X direction.

Figure 14:
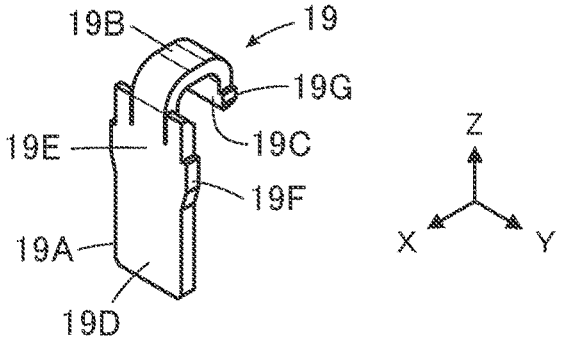
FIG. 14 is a perspective view of a second contact member used in the connector according to Embodiment 1, as viewed from an obliquely upper position.
Figure 15:
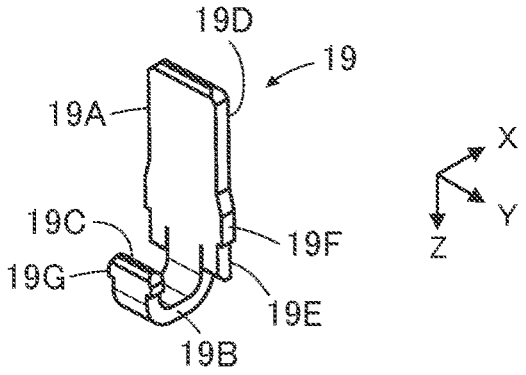
FIG. 15 is a perspective view of the second contact member used in the connector according to Embodiment 1, as viewed from an obliquely lower position.

FIGS. 14 and 15 show the configuration of the second contact member 19 retained in the retaining groove 16D of the long side portion situated on the +x direction side of the pair of long side portions of the projection portion 16B of the second insulator 16 shown in FIG. 7.

The second contact member 19 is composed of a strip-like member made of a conductive material such as metal and includes a flat plate portion 19A extending along the YZ plane. A joint portion 19B extending in the −X direction is connected to a +Z directional end of the flat plate portion 19A, and a fixing portion 19C bent in the −Z direction is connected to a −X directional end of the joint portion 19B.

Of a surface on the +X direction side of the flat plate portion 19A, a portion on the −Z direction side forms a second connection portion 19D that makes contact with a bottom surface of the connection object C, and a portion on the +Z direction side forms a second communication portion 19E to be connected to the first contact member 18. In other words, the second connection portion 19D and the second communication portion 19E are arranged side by side in the Z direction.

A +Z directional end of the flat plate portion 19A and the fixing portion 19C are respectively provided with press-fitted portions 19F and 19G protruding in a width direction of the strip-like member, i.e., the Y direction.

Meanwhile, the second contact member 19 retained in the retaining groove 16D of the long side portion situated on the −X direction side of the pair of long side portions of the projection portion 16B of the second insulator 16 shown in FIG. 7 has the same configuration as that of the second contact member 19 shown in FIGS. 14 and 15, but is disposed in an opposite orientation therefrom in the X direction.

Figure 16:
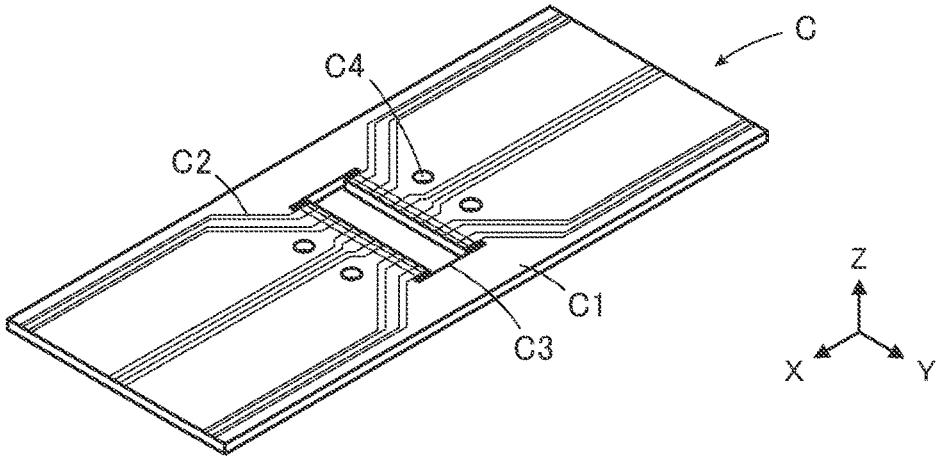
FIG. 16 is a perspective view of a connection object to which the connector according to Embodiment 1 is to be attached, as viewed from an obliquely upper position.
Figure 17:
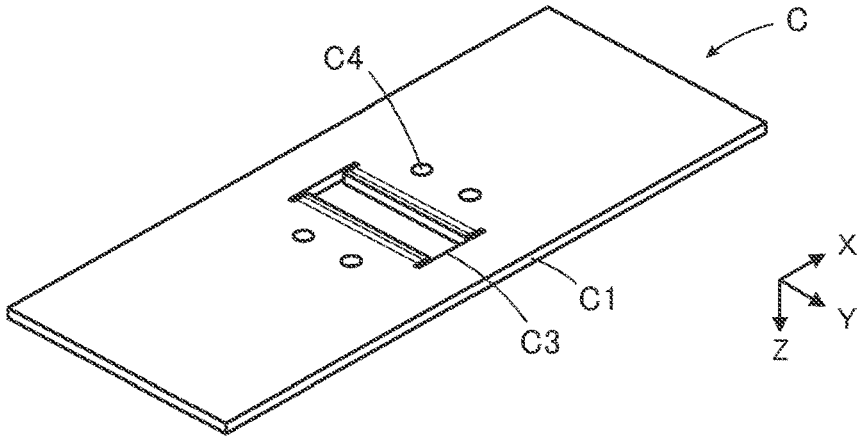
FIG. 17 is a perspective view of the connection object to which the connector according to Embodiment 1 is to be attached, as viewed from an obliquely lower position.

For the connection object C to which the connector 11 is attached, applicable examples include a garment having a so-called smart textile provided on its one surface with wiring formed by weaving of conductive fibers into the textile, printing of conductive ink, or other method. In the connection object C shown in FIG. 16, wiring made of a plurality of flexible conductors C2 is exposed on the top surface, which faces in +Z direction, of cloth C1 made of an insulating material. As shown in FIG. 17, the flexible conductors C2 are not exposed on the bottom surface, which faces the −Z direction, of the cloth C1.

The cloth C1 of the connection object C is provided with a rectangular opening portion C3, and one end of each of the plurality of flexible conductors C2 is situated at a +X directional edge or a −X directional edge of the opening portion C3. When the connector 11 is attached to the connection object C, the opening portion C3 receives the projection portion 16B of the second insulator 16. The opening portion C3 is formed to have a smaller width in the X direction than that of the projection portion 16B of the second insulator 16. Therefore, when the projection portion 16B of the second insulator 16 is inserted in the opening portion C3 from the −Z direction, portions of the connection object C situated at the +X directional edge and the −X directional edge of the opening portion C3 are pushed and bent in the +Z direction by the projection portion 16B.

A plurality of through-holes C4 are formed at each of opposite sides in the X direction of the opening portion C3 of the cloth C1. The through-holes C4 separately correspond to the plurality of fixing posts 17C of the third insulator 17, and the plurality of fixing posts 17C separately penetrate the plurality of through-holes C4.

The flat plate portion 18F of the first contact member 18 retained in the retaining groove 15F of the first insulator 15 is disposed along an inner surface of the recessed portion 15C of the first insulator 15, and the flat plate portion 19A of the second contact member 19 is inserted into the retaining groove 16D of the projection portion 16B of the second insulator 16; when the projection portion 16B of the second insulator 16 is inserted into the recessed portion 15C of the first insulator 15 at the time of assembling the connector 11, the first connection portion 18J and the first communication portion 18K of the first contact member 18 are disposed at positions to face the second connection portion 19D and the second communication portion 19E, respectively.

Further, when the projection portion 16B of the second insulator 16 is inserted into the recessed portion 15C of the first insulator 15, a distance between the first connection portion 18J of the first contact member 18 and the second connection portion 19D of the second contact member 19 is narrower than the thickness dimension of the connection object C. The elastic piece 18G of the first communication portion 18K of the first contact member 18 is pressed and electrically deformed by the second communication portion 19E of the second contact member 19, so that the first communication portion 18K and the second communication portion 19E make elastic contact with each other via the elastic piece 18G in the X direction.

When the connector 11 is attached to the connection object C, first, the plurality of first contact members 18 are pressed against the protruding portion 15B of frame shape of the first insulator 15 from +Z direction toward the −Z direction, whereby the plurality of first contact members 18 are separately retained in the plurality of retaining grooves 15F of the first insulator 15. At this time, the flat plate portion 18F of the first contact member 18 is inserted into the through-hole 15G of the first insulator 15, and the press-fitted portion 18L is press-fitted to an inner surface of the through-hole 15G, while the −Z directional end of the extending portion 18C of the first contact member 18 is inserted into the insertion hole (not shown) of the first insulator 15, and the press-fitted portion 18M is press-fitted to an inner surface of the insertion hole.

Likewise, the plurality of second contact members 19 are pressed against the projection portion 16B of the second insulator 16 from +Z direction toward the −Z direction, whereby the plurality of second contact members 19 are separately retained in the plurality of retaining grooves 16D of the second insulator 16. At this time, the flat plate portion 19A of the second contact member 19 is inserted into the retaining groove 16D of the second insulator 16, and the press-fitted portion 19F is press-fitted to a lateral surface of the retaining groove 16D, while the fixing portion 19C of the second contact member 19 is inserted into the insertion hole 16E of the second insulator 16, and the press-fitted portion 19G is press-fitted to an inner surface of the insertion hole 16E.

The projection portion 16B of the second insulator 16 by which the plurality of second contact members 19 are retained in this manner is sequentially passed through the opening portion C3 of the connection object C and the opening portion 14A of the tab sheet 14 from the −Z direction, and is further inserted into the recessed portion 15C of the first insulator 15 by which the plurality of first contact members 18 are retained. At this time, the +X directional edge and the −X directional edge of the opening portion C3 of the connection object C each enter between the projection portion 16B of the second insulator 16 and the recessed portion 15C of the first insulator 15 while being pushed and bent in the +Z direction by the projection portion 16B of the second insulator 16.

Subsequently, the third insulator 17 is moved from the +Z direction toward the −Z direction, the protruding portion 15B of the first insulator 15 is inserted into the opening portion 17B of the third insulator 17, and the plurality of fixing posts 17C of the third insulator 17 sequentially penetrate the plurality of through-holes 14B of the tab sheet 14, the plurality of through-holes C4 of the connection object C and the plurality of through-holes 16C of the second insulator 16.

Further, −Z directional ends, which project on the −Z directional side of the second insulator 16, of the plurality of fixing posts 17C of the third insulator 17 are heated and deformed, whereby the second insulator 16 is fixed to the first insulator 15.

Figure 18:
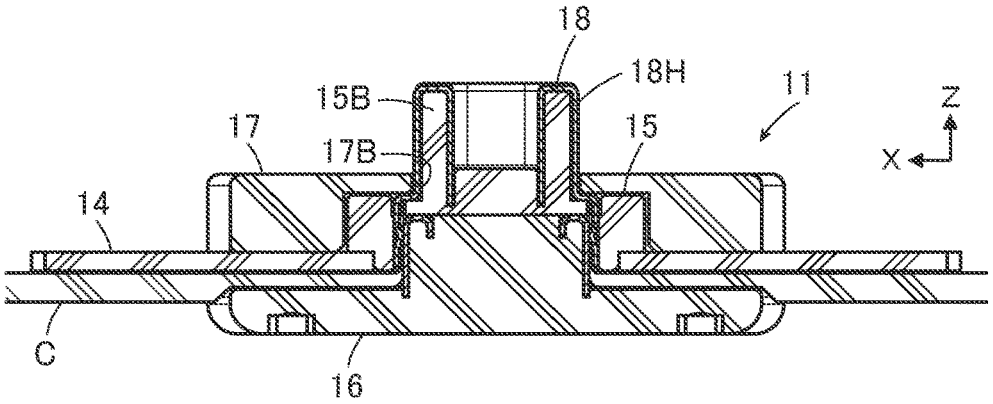
FIG. 18 is a cross-sectional view taken along line A-A in FIG. 3.

Thus, attachment of the connector 11 to the connection object C is completed as shown in FIG. 18.

The connection object C is, together with the tab sheet 14, sandwiched in the Z direction between the second insulator 16 and the third insulator 17, the protruding portion 15B of the first insulator 15 protrudes from the opening portion 17B of the third insulator 17 in the +Z direction, and the contact portions 18H of the plurality of first contact members 18 retained by the first insulator 15 are exposed on the +Z direction side of the connector 11.

Figure 19:
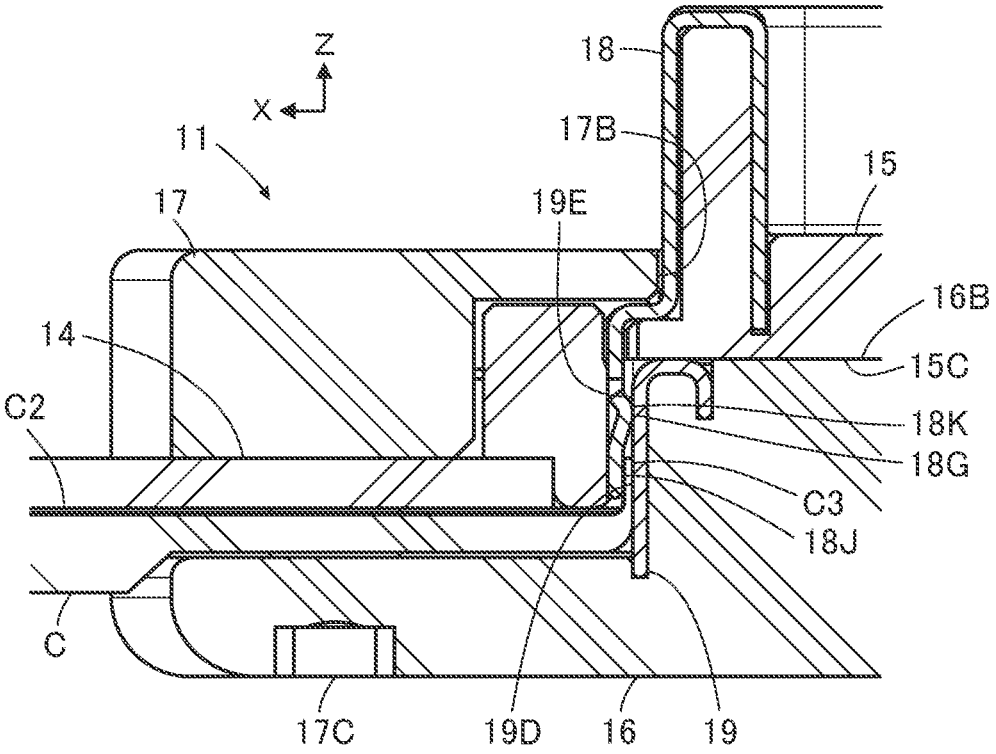
FIG. 19 is an enlarged view of an important part of FIG. 18.

As shown in FIG. 19, the first connection portion 18J and the first communication portion 18K of the first contact member 18 are disposed on the inner surface, which extends in the Z direction, of the recessed portion 15C of the first insulator 15, and the second connection portion 19D and the second communication portion 19E of the second contact member 19 are disposed on an outer surface, which extends in the Z direction, of the projection portion 16B of the second insulator 16.

Upon insertion of the projection portion 16B of the second insulator 16 into the recessed portion 15C of the first insulator 15, the elastic piece 18G of the first communication portion 18K of the first contact member 18 is pressed and elastically deformed by the second communication portion 19E of the second contact member 19, so that the first communication portion 18K and the second communication portion 19E make elastic contact with each other via the elastic piece 18G and are thereby electrically connected to each other.

Further, upon insertion of the projection portion 16B of the second insulator 16 into the recessed portion 15C of the first insulator 15, the +X directional edge and the −X directional edge of the opening portion C3 of the connection object C are each sandwiched between the first connection portion 18J of the first contact member 18 retained by the first insulator 15 and the second connection portion 19D of the second contact member 19 retained by the second insulator 16.

As a consequence, the connection object C is compressed in the thickness direction thereof, i.e., the X direction between the first connection portion 18J of the first contact member 18 and the second connection portion 19D of the second contact member 19, the first connection portion 18J of the first contact member 18 comes into contact with the top surface of the connection object C, and the second connection portion 19D of the second contact member 19 comes into contact with the bottom surface of the connection object C. Since the flexible conductor C2 is exposed on the top surface of the connection object C, the first connection portion 18J of the first contact member 18 is electrically connected to the flexible conductor C2 of the connection object C. In other words, the contact 13 composed of the first contact member 18 and the second contact member 19 is electrically connected to the flexible conductor C2 of the connection object C.

As shown in FIG. 19, a position where the first communication portion 18K of the first contact member 18 and the second communication portion 19E of the second contact member 19 are in elastic contact with each other via the elastic piece 18G is different from a place where the connection object C is sandwiched between the first connection portion 18J of the first contact member 18 and the second connection portion 19D of the second contact member 19, and the position is offset from the place to the 4Z direction side.

The first contact member 18 and the second contact member 19 are apart from each other by a predetermined gap around the elastic piece 18G.

Since the second connection portion 19D of the second contact member 19 comes into contact with the bottom surface of the connection object C, when the flexible conductor C2 is not exposed on the top surface but exposed on the bottom surface of the connection object C, the second connection portion 19D of the second contact member 19 is electrically connected to the flexible conductor C2. Since the second communication portion 19E of the second contact member 19 is electrically connected to the first communication portion 18K of the first contact member 18 via the elastic piece 18G, the contact 13 is electrically connected to the flexible conductor C2 of the connection object C also in this case.

With this configuration, the contact 13 can be electrically connected to the flexible conductor C2 of the connection object C regardless of whether the flexible conductor C2 is exposed on the top surface or the bottom surface of the connection object C.

Further, when the flexible conductor C2 is exposed on both surfaces of the connection object C by weaving of conductive fibers to the cloth C1 or other methods, both of the first connection portion 18J of the first contact member 18 and the second connection portion 19D of the second contact member 19 are connected to the flexible conductor C2, whereby the contact 13 is electrically connected to the flexible conductor C2 of the connection object C. Since a contact area between the flexible conductor C2 and the contact 13 increases when both of the first connection portion 18J and the second connection portion 19D contact the flexible conductor C2, the present invention is effective when a value of an electric current flowing between the contact 13 and the flexible conductor C2 is large.

Further, even when contact failure with respect to the flexible conductor C2 occurs in one of the first connection portion 18J and the second connection portion 19D, the contact 13 can be electrically connected to the flexible conductor C2 through the other of the first connection portion 18J and the second connection portion 19D.

When the second insulator 16 is assembled to the first insulator 15 in the Z direction which is the predetermined assembling direction D1, the elastic piece 18G of the first contact member 18 elastically deforms, whereby the first communication portion 18K of the first contact member 18 and the second communication portion 19E of the second contact member 19 make elastic contact with each other in the X direction. Thus, since the direction in which the first communication portion 18K and the second communication portion 19E are in elastic contact with each other is orthogonal to the predetermined assembling direction D1, the second insulator 16 assembled to the first insulator 15 is prevented from being detached from the first insulator 15 by an elastic force of the elastic piece 18G, and accordingly, the connector 11 can be maintained in a stable state. The direction in which the first communication portion 18K and the second communication portion 19E are in elastic contact with each other does not necessarily need to be orthogonal to the predetermined assembling direction D1 but preferably intersects the predetermined assembling direction D1.

In Embodiment 1 mentioned above, the first communication portion 18K of the first contact member 18 includes the elastic piece 18G, and the first communication portion 18K of the first contact member 18 and the second communication portion 19E of the second contact member 19 are in elastic contact with each other via the elastic piece 18G, but the invention is not limited thereto. Even when the elastic piece 18G is formed at the second communication portion 19E of the second contact member 19 instead of the first communication portion 18K of the first contact member 18, the first communication portion 18K and the second communication portion 19E likewise make elastic contact with each other via the elastic piece 18G, whereby the first contact member 18 and the second contact member 19 can be electrically connected to each other.

Embodiment 2

Figure 20:
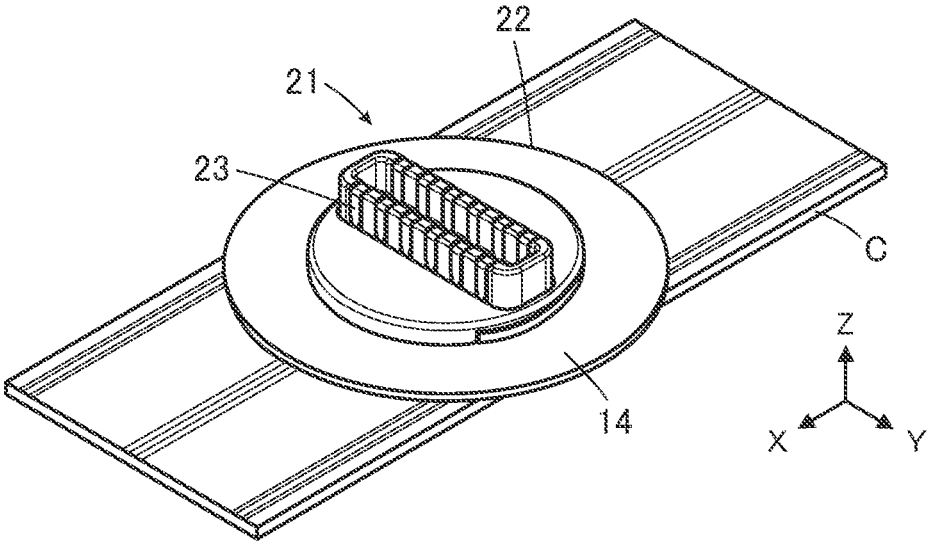
FIG. 20 is a perspective view of a connector according to Embodiment 2 attached to the connection object, as viewed from an obliquely upper position.
Figure 21:
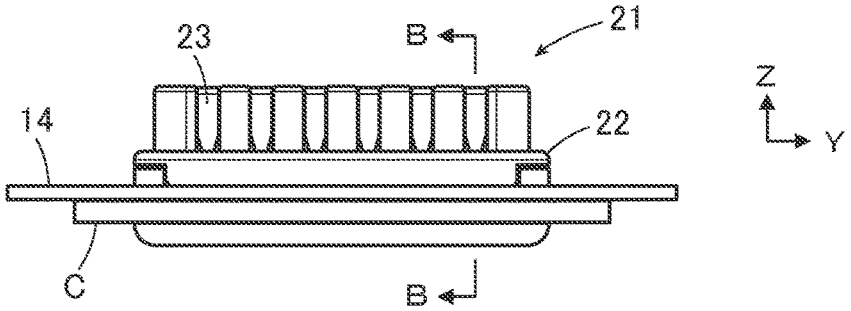
FIG. 21 is a front view of the connector according to Embodiment 2 attached to the connection object.

FIGS. 20 and 21 show a connector 21 according to Embodiment 2. As with the connector 11 of Embodiment 1, the connector 21 is attached to the connection object C and includes a connector body 22 made of an insulating material. In the connector body 22, a plurality of contacts 23 are retained to project perpendicularly to the connection object C in two lines parallel to each other.

The connector 21 is attached to the connection object C together with the tab sheet 14 used in Embodiment 1.

For convenience, the connection object C is defined as extending along an XY plane, the direction in which the contacts 23 are aligned is referred to as "Y direction," and the direction in which the contacts 23 each project is referred to as "+Z direction."

Figure 22:
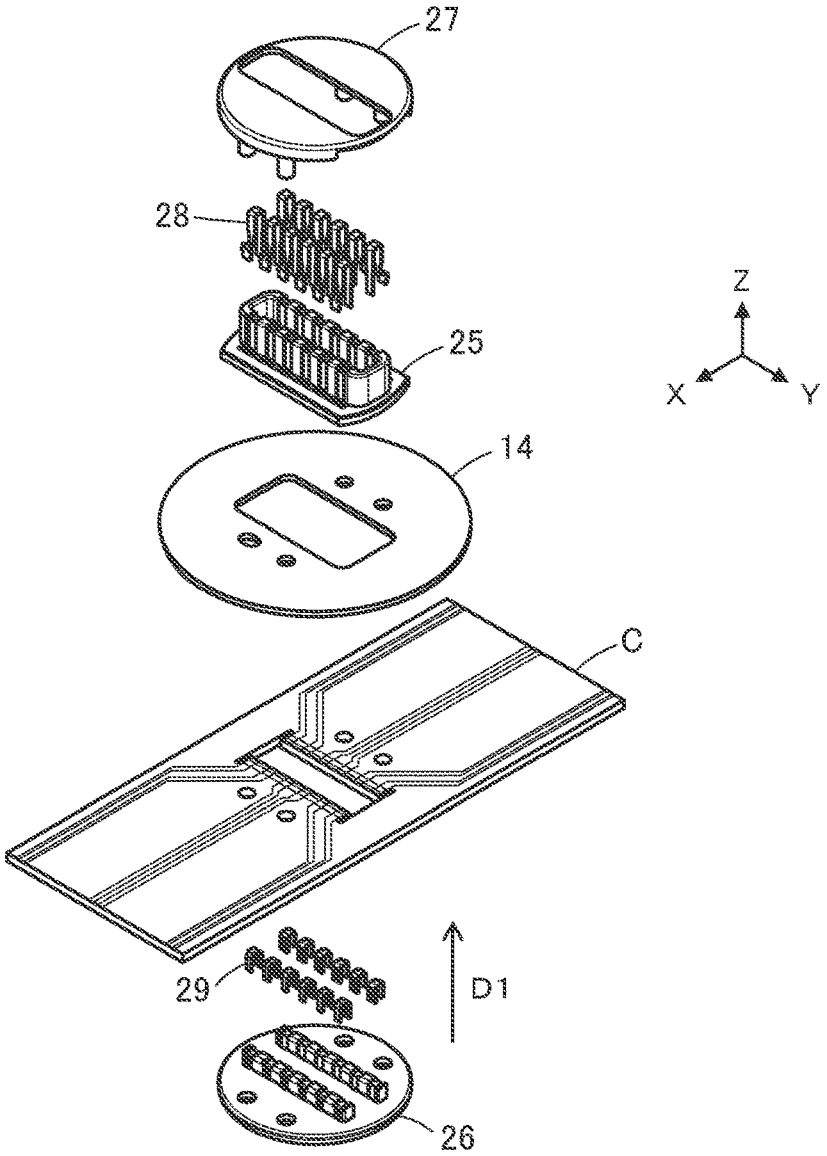
FIG. 22 is an exploded perspective view of the connector according to Embodiment 2.

As shown in FIG. 22, the connector 21 includes a first insulator 25, a second insulator 26 and a third insulator 27, and these first insulator 25, second insulator 26 and third insulator 27 constitute the connector body 22.

Each of the contacts 23 is composed of a first contact member 28 retained by the first insulator 25 and a second contact member 29 retained by the second insulator 26.

Figure 23:
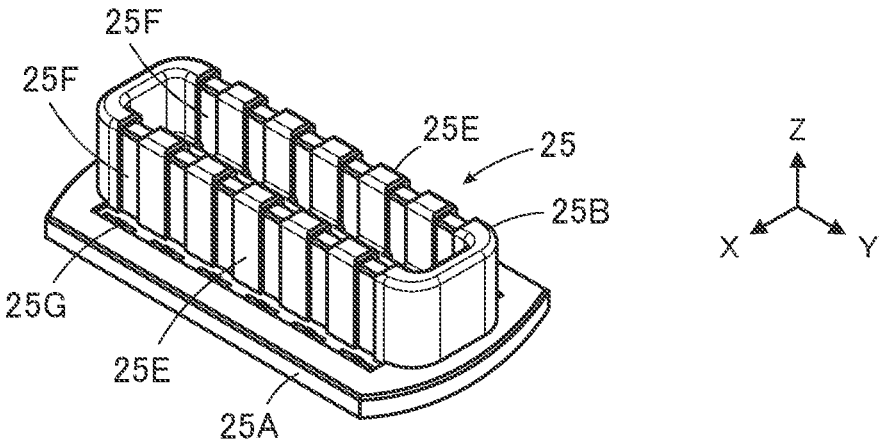
FIG. 23 is a perspective view of a first insulator used in the connector according to Embodiment 2, as viewed from an obliquely upper position.
Figure 24:
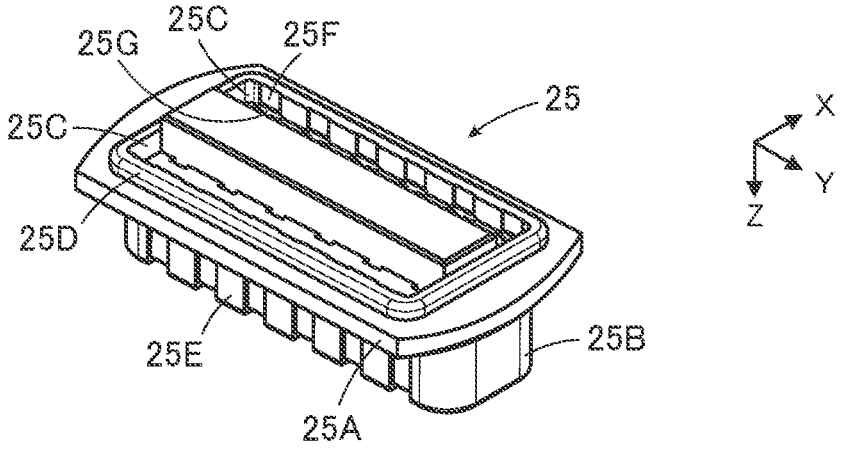
FIG. 24 is a perspective view of the first insulator used in the connector according to Embodiment 2, as viewed from an obliquely lower position.

As shown in FIGS. 23 and 24, the first insulator 25 includes a base portion 25A of flat plate shape extending along the XY plane and a protruding portion 25B of frame shape situated in the center of a surface on the +Z direction side of the base portion 25A and protruding in the +Z direction from the base portion 25A. The base portion 25A and the protruding portion 25B each have a substantially rectangular outer shape with long sides extending in the Y direction and short sides extending in the X direction when viewed in the Z direction.

At a surface on the −Z direction side of the base portion 25A, a pair of recessed portions 25C extending in the Y direction, arranged in parallel with a distance therebetween in the X direction and opening in the −Z direction are formed, and a protruding portion 25D projecting in the −Z direction is formed to surround the recessed portions 25C.

The protruding portion 25B of frame shape includes a pair of long side portions 25E facing each other in the X direction and extending in the Y direction, and a plurality of retaining grooves 25F for separately retaining the plurality of first contact members 28 are formed at each of an outer surface, an inner surface and an upper surface, which faces in the +Z direction, of each of the long side portions 25E.

The base portion 25A is provided with a plurality of through-holes 25G separately corresponding to the plurality of retaining grooves 25F and penetrating from the surface on the +Z direction side of the base portion 25A through the corresponding recessed portion 25C. Although not shown in FIG. 23, a plurality of through-holes separately connected to the plurality of retaining grooves 25F are formed in the base portion 25A in the region surrounded by the protruding portion 25B of frame shape.

Figure 25:
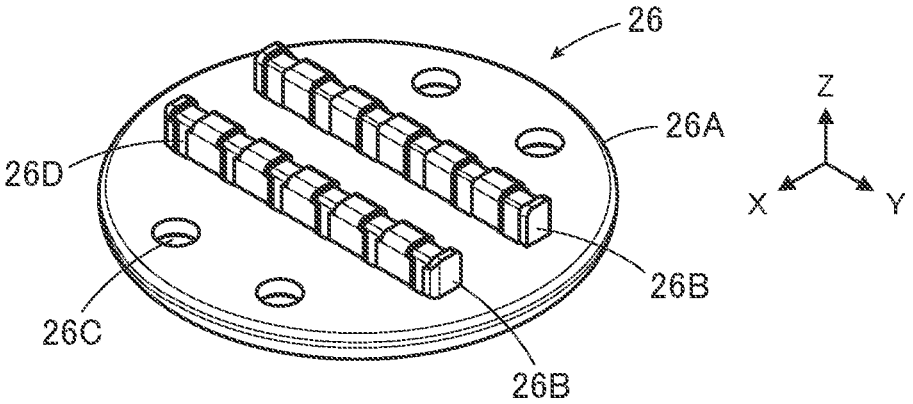
FIG. 25 is a perspective view of a second insulator used in the connector according to Embodiment 2, as viewed from an obliquely upper position.

As shown in FIG. 25, the second insulator 26 includes a base portion 26A of circular disk shape extending along the XY plane, and a pair of projection portions 26B projecting in the +Z direction from a surface on the +Z direction side of the base portion 26A. The pair of projection portions 26B extend in the Y direction and are disposed in parallel with a distance therebetween in the X direction.

When the second insulator 26 is assembled to the first insulator 25, each of the projection portions 26B is inserted into the corresponding recessed portion 25C of the first insulator 25. Each of the projection portions 26B has a size slightly smaller than that of the recessed portion 25C in the XY plane.

The base portion 26A is provided with a plurality of through-holes 26C arranged on each of opposite sides in the X direction of the pair of projection portions 26B. Each of the projection portions 26B has a rectangular outer shape with long sides extending in the Y direction and short sides extending in the X direction when viewed in the Z direction, and a plurality of retaining grooves 26D for separately retaining the second contact members 29 are formed at each of opposite lateral surfaces of long side portions and upper surfaces of the projection portions 26B.

Figure 26:
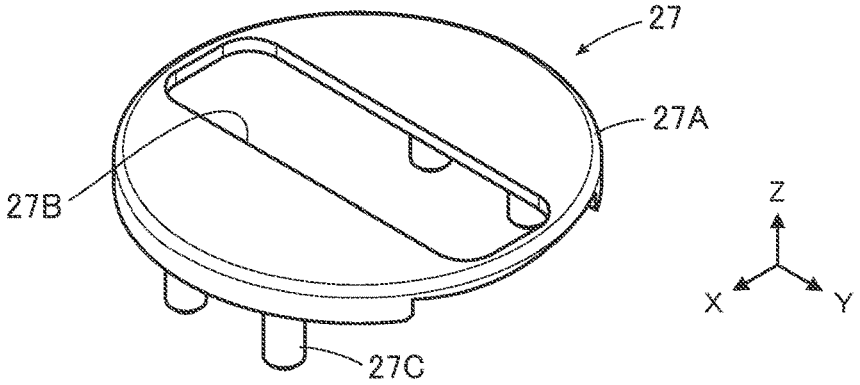
FIG. 26 is a perspective view of a third insulator used in the connector according to Embodiment 2, as viewed from an obliquely upper position.

As shown in FIG. 26, the third insulator 27 has the same configuration as that of the third insulator 17 of Embodiment 1. In other words, the third insulator 27 includes a base portion 27A of circular disk shape extending along the XY plane, a substantially rectangular opening portion 27B is formed in the middle of the base portion 27A, and a plurality of fixing posts 27C projecting in the −Z direction are formed at a surface on the −Z direction side of the base portion 27A on each of opposite sides in the X direction of the opening portion 27B.

Figure 27:
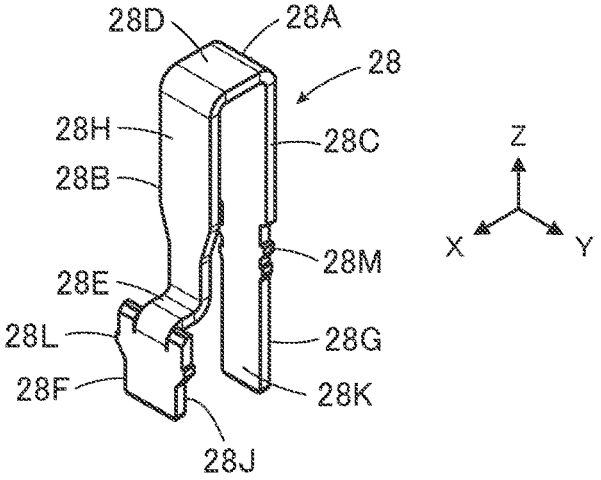
FIG. 27 is a perspective view of a first contact member used in the connector according to Embodiment 2, as viewed from an obliquely upper position.
Figure 28:
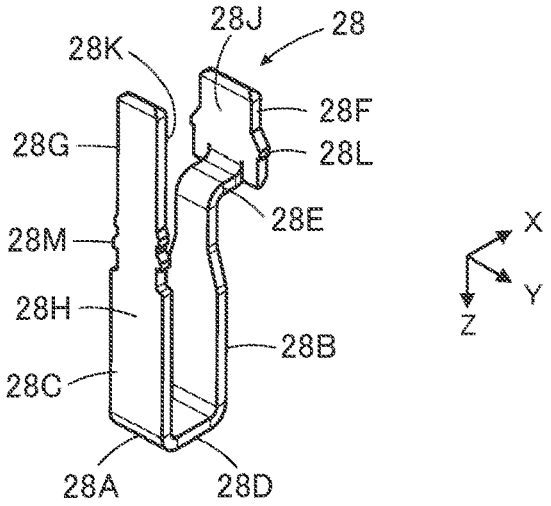
FIG. 28 is a perspective view of the first contact member used in the connector according to Embodiment 2, as viewed from an obliquely lower position.

FIGS. 27 and 28 show the configuration of the first contact member 28 retained in the retaining groove 25F of the long side portion 25E situated on the +X direction side of the pair of long side portions 25E of the protruding portion 25B of the first insulator 25 shown in FIG. 23.

The first contact member 28 is composed of a strip-like member made of a conductive material such as metal and includes a U-shaped portion 28A bent in a U shape. The U-shaped portion 28A is composed of a pair of extending portions 28B and 28C extending along the YZ plane and facing each other in the X direction and a joint portion 28D that joints +Z directional ends of the pair of extending portions 28B and 28C to each other. A flat plate portion 28F extending along the YZ plane is connected via a step portion 28E to a −Z directional end of the extending portion 28B.

A −Z directional end of the extending portion 28C is connected to a flat plate portion 28G further extending in the −Z direction along the YZ plane.

An outer surface of the U-shaped portion 28A forms a contact portion 28H that makes contact with a contact of a counter connector, a surface on the −X direction side of the flat plate portion 28F forms a first connection portion 28J that makes contact with the top surface of the connection object C, and a surface on the +X direction side of the flat plate portion 28G forms a first communication portion 28K to be connected to the second contact member 29. In other words, the first connection portion 28J and the first communication portion 28K are separately arranged on opposite ends of the first contact member 28 and face each other with a distance therebetween in the X direction.

A +Z directional end of the flat plate portion 28F and a +Z directional end of the flat plate portion 28G are respectively provided with press-fitted portions 28L and 28M projecting in a width direction of the strip-like member, i.e., the Y direction.

Meanwhile, the first contact member 28 retained in the retaining groove 25F of the long side portion 25E situated on the −X direction side of the pair of long side portions 25E of the protruding portion 25B of the first insulator 25 shown in FIG. 23 has the same configuration as that of the first contact member 28 shown in FIGS. 27 and 28 but is disposed in an opposite orientation therefrom in the X direction.

Figure 29:
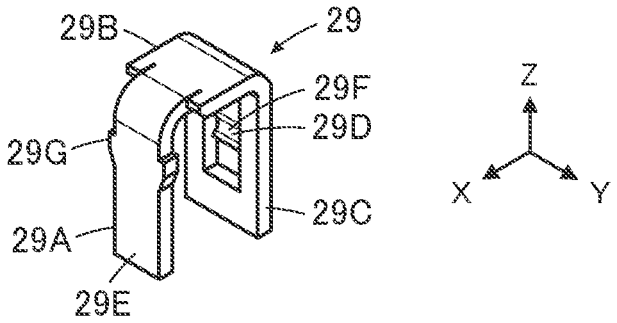
FIG. 29 is a perspective view of a second contact member used in the connector according to Embodiment 2, as viewed from an obliquely upper position.
Figure 30:
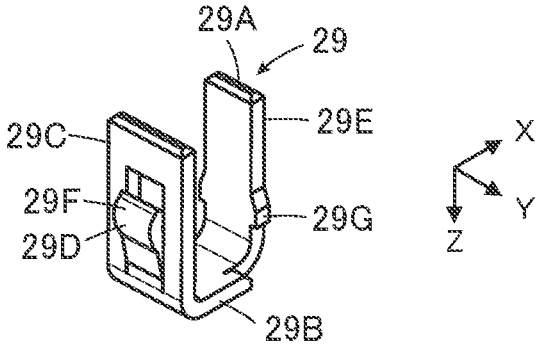
FIG. 30 is a perspective view of the second contact member used in the connector according to Embodiment 2, as viewed from an obliquely lower position.

FIGS. 29 and 30 show the configuration of the second contact member 29 retained in the retaining groove 26D of the projection portion 26B situated on the +X direction side of the pair of projection portions 26B of the second insulator 26 shown in FIG. 25.

The second contact member 29 is composed of a strip-like member made of a conductive material such as metal and includes a flat plate portion 29A extending along the YZ plane, a joint portion 29B extending in the −X direction is connected to a +Z directional end of the flat plate portion 29A, and a flat plate portion 29C extending in the −Z direction along the YZ plane is connected to a −X directional end of the joint portion 29B.

The flat plate portion 29C has formed in its middle an elastic piece 29D protruding in the −X direction.

A surface on the +X direction side of the flat plate portion 29A forms a second connection portion 29E that makes contact with the bottom surface of the connection object C, and the elastic piece 29D forms a second communication portion 29F to be connected to the first contact member 28. In other words, the second connection portion 29E and the second communication portion 29F are disposed to be spaced apart from each other in the X direction and face in opposite directions to each other.

The +Z directional end of the flat plate portion 29A is provided with a press-fitted portion 29G protruding in a width direction of the strip-like member, i.e., the Y direction.

Meanwhile, the second contact member 29 retained in the retaining groove 26D of the projection portion 26B situated on the −X direction side of the pair of projection portions 26B of the second insulator 26 shown in FIG. 25 has the same configuration as that of the second contact member 29 shown in FIGS. 29 and 30, but is disposed in an opposite orientation therefrom in the X direction.

Upon insertion of the projection portion 26B of the second insulator 26 into the recessed portion 25C of the first insulator 25, the elastic piece 29D of the second communication portion 29F of the second contact member 29 is pressed and elastically deformed by the first communication portion 28K of the first contact member 28, so that the first communication portion 28K and the second communication portion 29F make elastic contact with each other via the elastic piece 29D in the X direction.

Attachment of the connector 21 to the connection object C is performed in the same manner as the connector 11 of Embodiment 1. In other words, after the plurality of first contact members 28 are separately retained in the plurality of retaining grooves 25F of the first insulator 25, and the plurality of second contact members 29 are separately retained in the plurality of retaining grooves 26D of the second insulator 26, the pair of projection portions 26B of the second insulator 26 are sequentially passed through the opening portion C3 of the connection object C shown in FIG. 16 and the opening portion 14A of the tab sheet 14 shown in FIG. 11 from −Z direction, and are separately inserted into the pair of recessed portions 25C of the first insulator 25. At this time, each of the +X directional edge and the −X directional edge of the opening portion C3 of the connection object C enters between the corresponding projection portion 26B of the second insulator 26 and the corresponding recessed portion 25C of the first insulator 25 while being pushed and bent in the +Z direction by the corresponding projection portion 26B of the second insulator 26.

Figure 31:
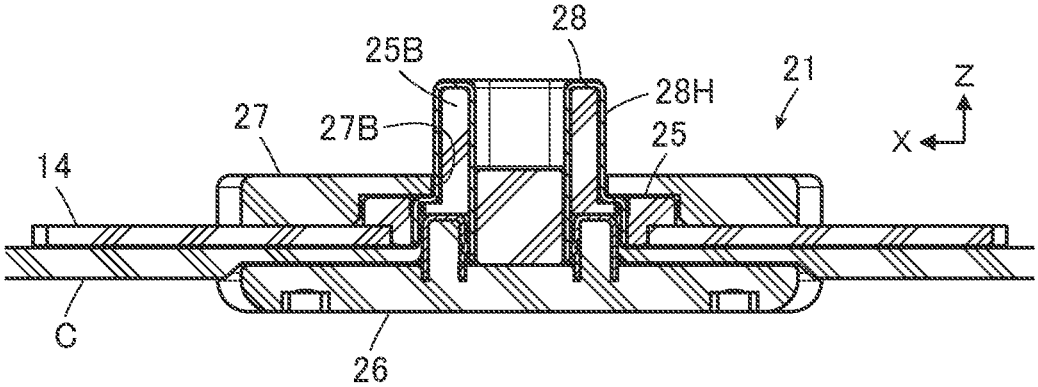
FIG. 31 is a cross-sectional view taken along line B-B in FIG. 21.

Further, the protruding portion 25B of the first insulator 25 is inserted into the opening portion 27B of the third insulator 27, the plurality of fixing posts 27C of the third insulator 27 are sequentially inserted into the plurality of through-holes 14B of the tab sheet 14, the plurality of through-holes C4 of the connection object C and the plurality of through-holes 26C of the second insulator 26, and −Z directional ends, which project on the −Z direction side of the second insulator 26, of the plurality of fixing posts 27C of the third insulator 27 are heated and deformed, whereby the connector 21 is attached to the connection object C as shown in FIG. 31.

The connection object C is, together with the tab sheet 14, sandwiched in the Z direction between the second insulator 26 and the third insulator 27, and the protruding portion 25B of the first insulator 25 protrudes from the opening portion 27B of the third insulator 27 in the +Z direction, and the contact portions 28H of the plurality of first contact members 28 retained by the first insulator 25 are exposed on the +Z direction side of the connector 21.

Figure 32:
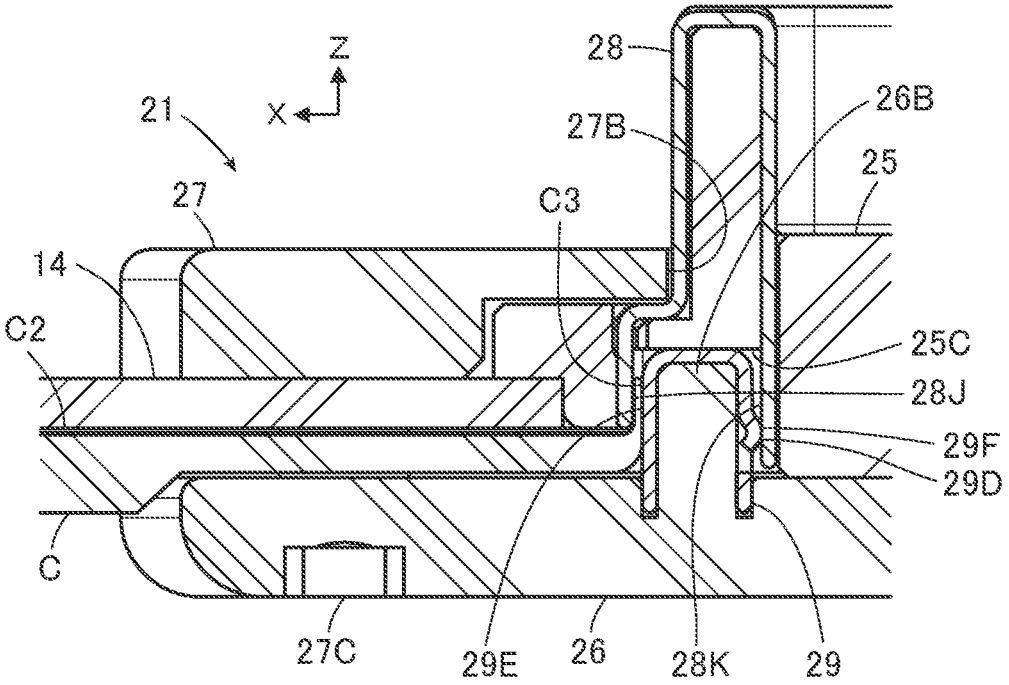
FIG. 32 is an enlarged view of an important part of FIG. 31.

As shown in FIG. 32, the first connection portion 28J and the first communication portion 28K of the first contact member 28 are separately disposed on a pair of inner surfaces, which face each other in the X direction, of the recessed portion 25C of the first insulator 25, and the second connection portion 29E and the second communication portion 29F of the second contact member 29 are separately disposed on a pair of outer surfaces, which face in opposite directions to each other, of the projection portion 26B of the second insulator 26.

Upon insertion of the projection portion 26B of the second insulator 26 into the recessed portion 25C of the first insulator 25, the elastic piece 29D of the second communication portion 29F of the second contact member 29 is pressed and elastically deformed by the first communication portion 28K of the first contact member 28, so that the first communication portion 28K and the second communication portion 29F make elastic contact with each other via the elastic piece 29D to thereby be electrically connected to each other.

Further, upon insertion of the projection portion 26B of the second insulator 26 into the recessed portion 25C of the first insulator 25, the +X directional edge and the −X directional edge of the opening portion C3 of the connection object C are each sandwiched between the first connection portion 28J of the first contact member 28 retained by the first insulator 25 and the second connection portion 29E of the second contact member 29 retained by the second insulator 26.

The connection object C is compressed in the thickness direction thereof, i.e., the X direction between the first connection portion 28J of the first contact member 28 and the second connection portion 29E of the second contact member 29, the first connection portion 28J of the first contact member 28 comes into contact with the top surface of the connection object C, and the second connection portion 29E of the second contact member 29 comes into contact with the bottom surface of the connection object C. Since the flexible conductor C2 is exposed on the top surface of the connection object C, the first connection portion 28J of the first contact member 28 is electrically connected to the flexible conductor C2 of the connection object C. In other words, the contact 23 composed of the first contact member 28 and the second contact member 29 is electrically connected to the flexible conductor C2 of the connection object C.

Thus, also in the connector 21 of Embodiment 2 having the first contact member 28 shown in FIGS. 27 and 28 and the second contact member 29 shown in FIGS. 29 and 30, the first connection portion 28J of the first contact member 28 comes into contact with the top surface of the connection object C, and at the same time, the second connection portion 29E of the second contact member 29 comes into contact with the bottom surface of the connection object C. Therefore, as with the connector 11 of Embodiment 1, the contact 23 can be electrically connected to the flexible conductor C2 of the connection object C regardless of whether the flexible conductor C2 is exposed on the top surface, the bottom surface, or both surfaces of the connection object C.

When the second insulator 26 is assembled to the first insulator 25 in the Z direction which is the predetermined assembling direction D1, the elastic piece 29D of the second contact member 29 elastically deforms, whereby the first communication portion 28K of the first contact member 28 and the second communication portion 29F of the second contact member 29 make elastic contact with each other in the X direction. Thus, since the direction in which the first communication portion 28K and the second communication portion 29F are in elastic contact with each other is orthogonal to the predetermined assembling direction D1, the second insulator 26 assembled to the first insulator 25 is prevented from being detached from the first insulator 25 by an elastic force of the elastic piece 29D, and accordingly, the connector 21 can be maintained in a stable state. While the direction in which the first communication portion 28K and the second communication portion 29F are in elastic contact with each other does not necessarily need to be orthogonal to the predetermined assembling direction D1, the direction preferably intersects the predetermined assembling direction D1.

While in Embodiment 2 mentioned above, the second communication portion 29F of the second contact member 29 includes the elastic piece 29D, even when the first communication portion 28K of the first contact member 28 instead of the second communication portion 29F of the second contact member 29 includes the elastic member 29D, the first communication portion 28K and the second communication portion 29F likewise make elastic contact with each other via the elastic piece 29D, whereby the first contact member 28 and the second contact member 29 can be electrically connected to each other.

Embodiment 3

Figure 33:
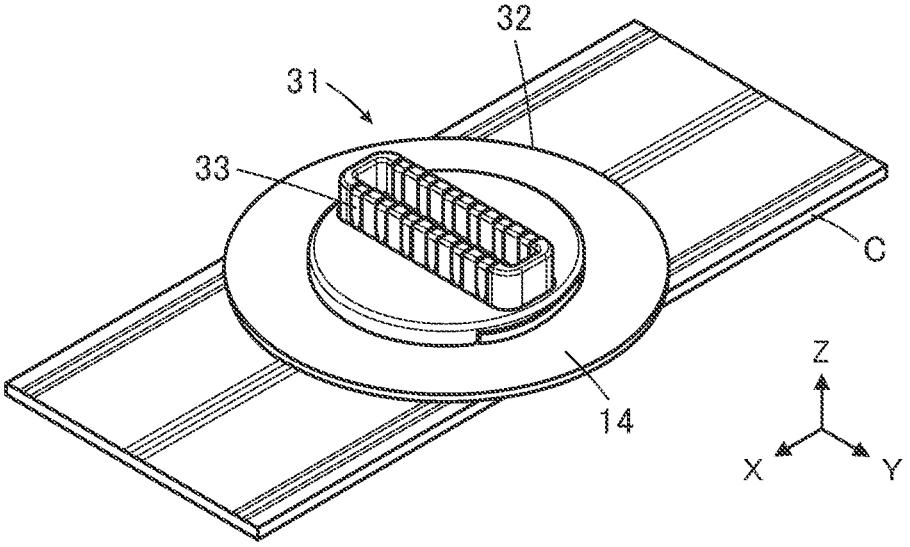
FIG. 33 is a perspective view of a connector according to Embodiment 3 attached to the connection object, as viewed from an obliquely upper position.
Figure 34:
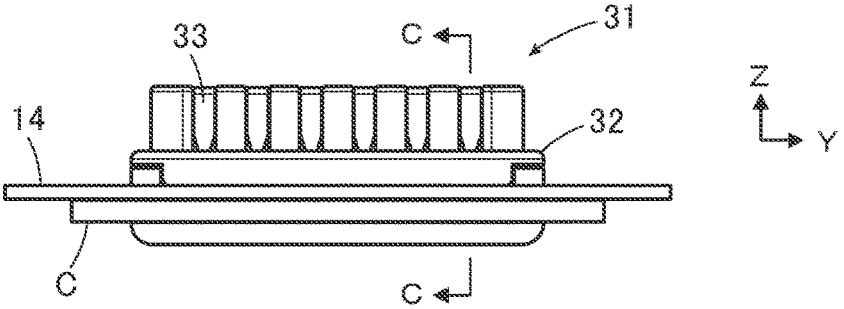
FIG. 34 is a front view of the connector according to Embodiment 3 attached to the connection object.

FIGS. 33 and 34 show a connector 31 according to Embodiment 3. As with the connector 11 of Embodiment 1, the connector 31 is attached to the connection object C and includes a connector body 32 made of an insulating material. In the connector body 32, a plurality of contacts 33 are retained to project perpendicularly to the connection object C in two lines parallel to each other.

The connector 31 is attached to the connection object C together with the tab sheet 14 used in Embodiment 1.

For convenience, the connection object C is defined as extending along an XY plane, the direction in which the contacts 33 are aligned is referred to as "Y direction," and the direction in which the contacts 33 project is referred to as "+2 direction."

Figure 35:
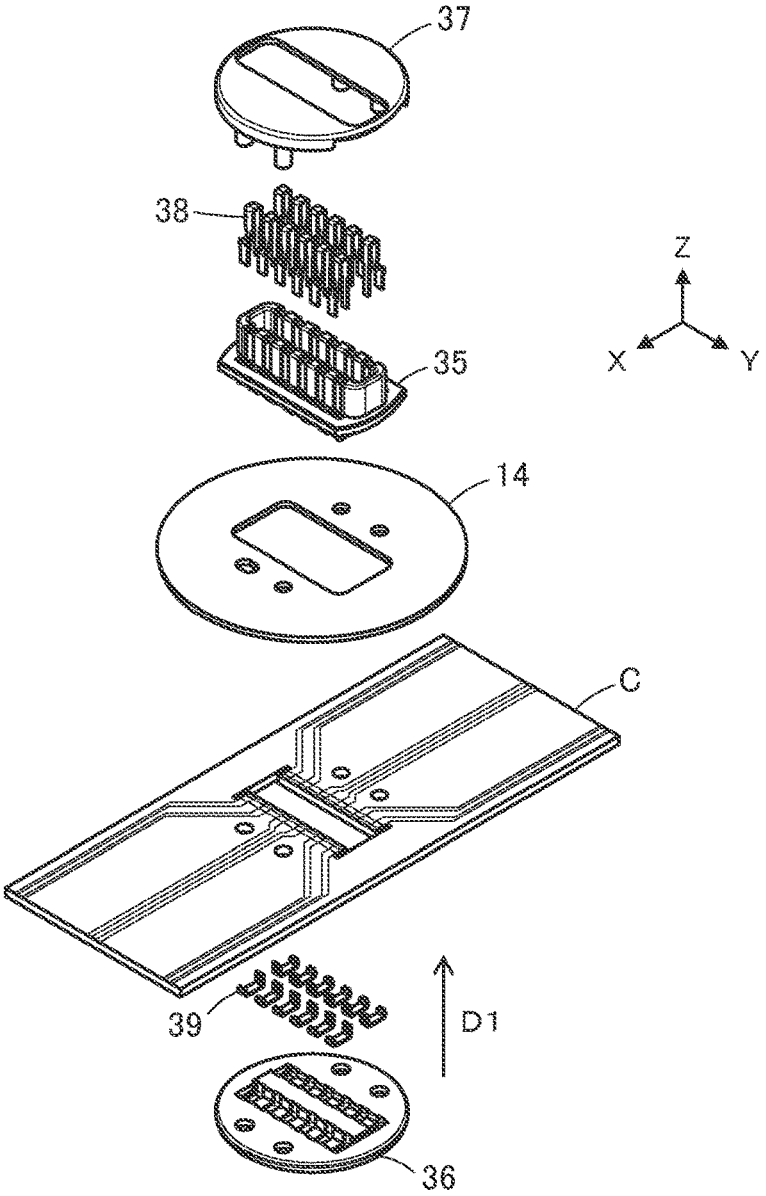
FIG. 35 is an exploded perspective view of the connector according to Embodiment 3.

As shown in FIG. 35, the connector 31 includes a first insulator 35, a second insulator 36 and a third insulator 37, and these first insulator 35, second insulator 36 and third insulator 37 constitute the connector body 32.

Each of the contacts 33 is composed of a first contact member 38 retained by the first insulator 35 and a second contact member 39 retained by the second insulator 36.

Figure 36:
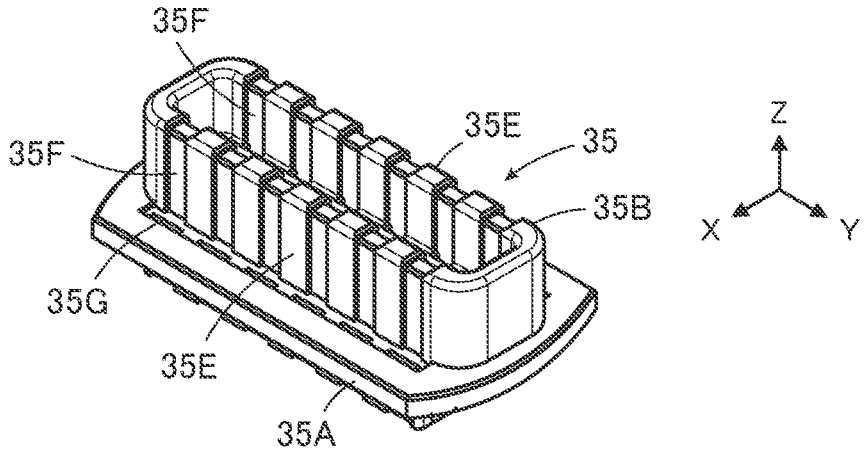
FIG. 36 is a perspective view of a first insulator used in the connector according to Embodiment 3, as viewed from an obliquely upper position.
Figure 37:
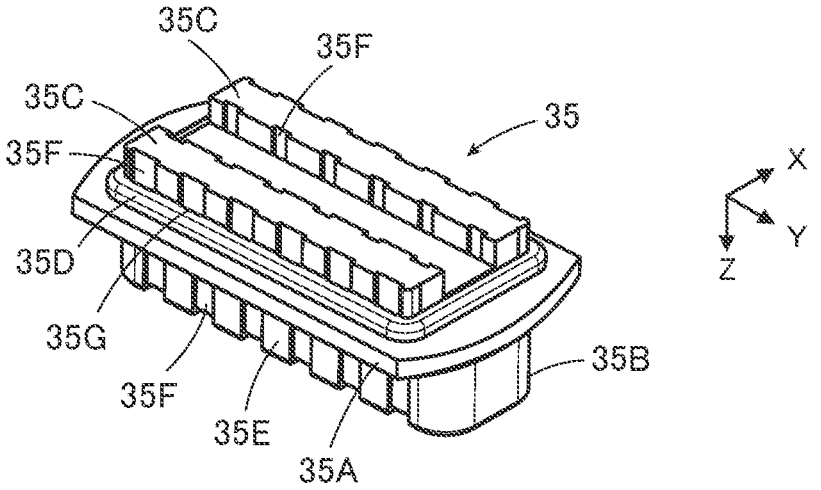
FIG. 37 is a perspective view of the first insulator used in the connector according to Embodiment 3, as viewed from an obliquely lower position.

As shown in FIGS. 36 and 37, the first insulator 35 includes a base portion 35A of flat plate shape extending along the XY plane and a protruding portion 35B of frame shape situated in the center of a surface on the +Z direction side of the base portion 35A and protruding in the +Z direction from the base portion 35A. The base portion 35A and the protruding portion 35B each have a substantially rectangular outer shape with long sides extending in the Y direction and short sides extending in the X direction when viewed in the Z direction.

At a surface on the −Z direction side of the base portion 35A, a pair of projection portions 35C extending in the Y direction, arranged in parallel with a distance therebetween in the X direction and projecting in the −Z direction are formed, and a protruding portion 35D projecting in the −Z direction is formed to surround the projection portions 35C.

The protruding portion 35B of frame shape protruding in the +Z direction from the base portion 35A includes a pair of long side portions 35E facing each other in the X direction and extending in the Y direction, and a plurality of retaining grooves 35F for separately retaining the plurality of first contact members 38 are formed at each of an outer surface, an inner surface and an upper surface, which faces in the +Z direction, of each of the long side portions 35E.

The plurality of retaining grooves 35F formed at the inner surfaces of the pair of long side portions 35E penetrate the base portion 35A in the Z direction and extend in the Z direction along lateral surfaces, which face each other, of the pair of projection portions 35C projecting on the −Z direction side of the base portion 35A.

In the base portion 35A, a plurality of through-holes 35G separately corresponding to the plurality of retaining grooves 35F and penetrating from the surface on the +Z direction side through the −Z direction side of the base portion 35A are formed near each of outer surfaces of the pair of long side portions 35E. A plurality of retaining grooves 35F separately connected to the plurality of through-holes 35G and extending in the Z direction are formed at each of outer lateral surfaces, which face in opposite directions to each other, of the pair of projection portions 35C projecting on the −Z direction side of the base portion 35A.

Figure 38:
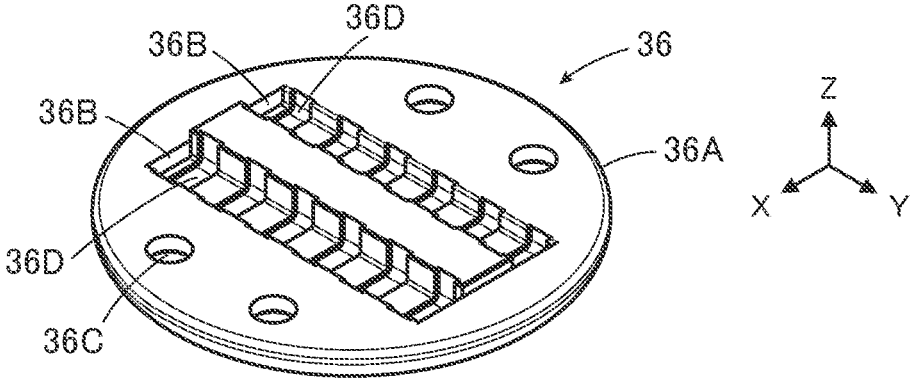
FIG. 38 is a perspective view of a second insulator used in the connector according to Embodiment 3, as viewed from an obliquely upper position.

As shown in FIG. 38, the second insulator 36 includes a base portion 36A of circular disk shape extending along the XY plane, and a pair of recessed portions 36B opening in the +Z direction are formed at a surface on the −Z direction side of the base portion 36A. The pair of recessed portions 36B extend in the Y direction and are disposed in parallel with a distance therebetween in the X direction.

When the second insulator 36 is assembled to the first insulator 35, each of the recessed portions 36B receives the corresponding projection portion 35C of the first insulator 35. Each of the recessed portions 36B has a size slightly smaller than that of the projection portion 35C in the XY plane.

The base portion 36A is provided with a plurality of through-holes 36C arranged on each of opposite sides in the X direction of the pair of recessed portions 36B. Each of the recessed portions 36B has a rectangular outer shape with long sides extending in the Y direction and short sides extending in the X direction when viewed in the Z direction, and a plurality of retaining grooves 36D for separately retaining the second contact members 39 are formed at each of opposite lateral surfaces of the long side portions and bottom surfaces of the recessed portions 36B.

Figure 39:
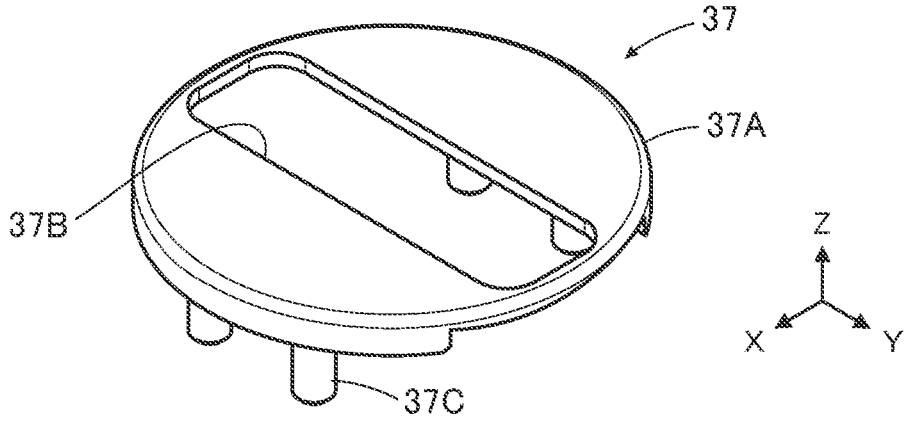
FIG. 39 is a perspective view of a third insulator used in the connector according to Embodiment 3, as viewed from an obliquely upper position.

As illustrated in FIG. 39, the third insulator 37 has the same configuration as that of the third insulator 17 of Embodiment 1. In other words, the third insulator 37 includes a base portion 37A of circular disk shape extending along the XY plane, a substantially rectangular opening portion 37B is formed in the middle of the base portion 37A, and a plurality of fixing posts 37C projecting in the −Z direction are formed at a surface on the −Z direction side of the base portion 37A on each of opposite sides in the X direction of the opening portion 37B.

Figure 40:
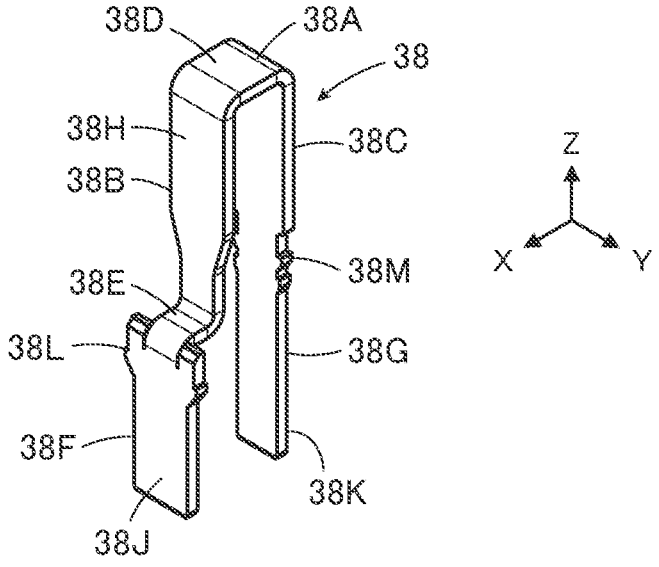
FIG. 40 is a perspective view of a first contact member used in the connector according to Embodiment 3, as viewed from an obliquely upper position.
Figure 41:
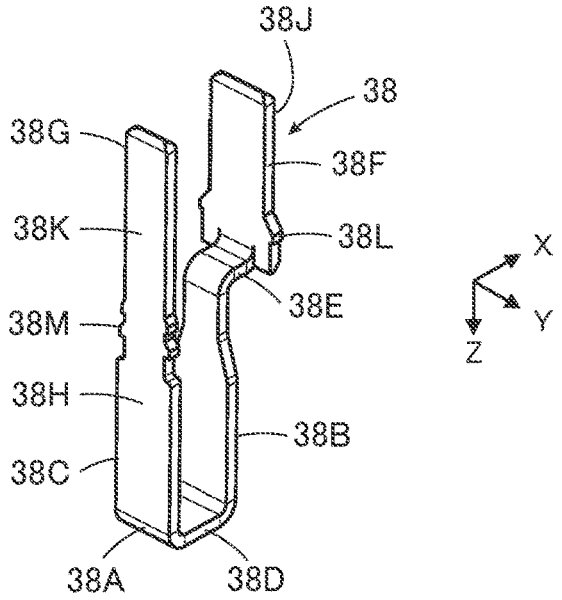
FIG. 41 is a perspective view of the first contact member used in the connector according to Embodiment 3, as viewed from an obliquely lower position.

FIGS. 40 and 41 show the configuration of the first contact member 38 retained in the retaining groove 35F of the long side portion 35E situated on the +X direction side of the pair of long side portions 35E of the protruding portion 35B of the first insulator 35 shown in FIG. 36.

The first contact member 38 is composed of a strip-like member made of a conductive material such as metal and includes a U-shaped portion 38A bent in a U shape. The U-shaped portion 38A is composed of a pair of extending portions 38B and 38C extending along the YZ plane and facing each other in the X direction and a joint portion 38D that joins +Z directional ends of the pair of extending portions 38B and 38C to each other. A flat plate portion 38F extending along the YZ plane is connected via a step portion 38E to a −Z directional end of the extending portion 38B.

A −Z directional end of the extending portion 38C is connected to a flat plate portion 38G further extending in the −Z direction along the YZ plane.

An outer surface of the U-shaped portion 38A forms a contact portion 38H that makes contact with a contact of a counter connector, a surface on the +X direction side of the flat plate portion 38F forms a first connection portion 38J that makes contact with the top surface of the connection object C, and a surface on the −X direction side of the flat plate portion 38G forms a first communication portion 38K to be connected to the second contact member 39. In other words, the first connection portion 38J and the first communication portion 38K are separately arranged on opposite ends of the first contact member 38 and face in opposite directions to each other with a distance therebetween in the X direction.

A +Z directional end of the flat plate portion 38F and a +Z directional end of the flat plate portion 38G are respectively provided with press-fitted portions 38L and 38M protruding in a width direction of the strip-like member, i.e., the Y direction.

Meanwhile, the first contact member 38 retained in the retaining groove 35F of the long side portion 35E situated on the −X direction side of the pair of long side portions 35E of the protruding portion 35B of the first insulator 35 shown in FIG. 36 has the same configuration as that of the first contact member 38 shown in FIGS. 40 and 41 but is disposed in an opposite orientation therefrom in the X direction.

Figure 42:
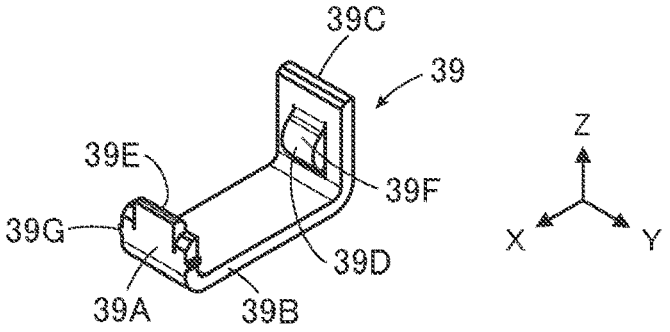
FIG. 42 is a perspective view of a second contact member used in the connector according to Embodiment 3, as viewed from an obliquely upper position.
Figure 43:
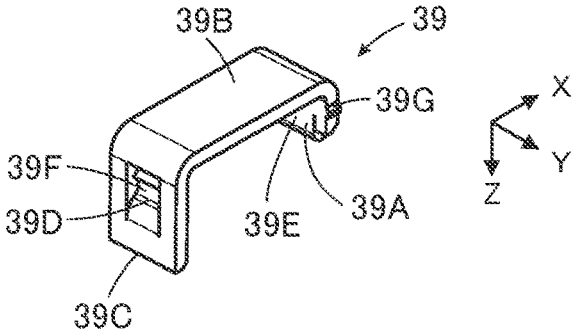
FIG. 43 is a perspective view of the second contact member used in the connector according to Embodiment 3, as viewed from an obliquely lower position.

FIGS. 42 and 43 show the configuration of the second contact member 39 retained in the retaining groove 36D of the recessed portion 36B situated on the +X direction side of the pair of recessed portions 36B of the second insulator 36 shown in FIG. 38.

The second contact member 39 is composed of a strip-like member made of a conductive material such as metal and includes a flat plate portion 39A extending along the YZ plane, a joint portion 39B extending in the −X direction is connected to a −Z directional end of the flat plate portion 39A, and a flat plate portion 39C extending in the +Z direction along the YZ plane is connected to a −X directional end of the joint portion 39B.

The flat plate portion 39C has formed in its middle an elastic piece 39D protruding in the −X direction.

A surface on the −X direction side of the flat plate portion 39A forms a second connection portion 39E that makes contact with the bottom surface of the connection object C, and the elastic piece 39D forms a second communication portion 39F to be connected to the first contact member 38. In other words, the second connection portion 39B and the second communication portion 39F are disposed to be spaced apart from each other in the X direction and face each other.

The flat plate portion 39A is provided with a press-fitted portion 39G protruding in a width direction of the strip-like member, i.e., the Y direction.

Meanwhile, the second contact member 39 retained in the retaining groove 36D of the recessed portion 36B situated on the −X direction side of the pair of recessed portions 36B of the second insulator 36 shown in FIG. 38 has the same configuration as that of the second contact member 39 shown in FIGS. 42 and 43, but is disposed in an opposite orientation therefrom in the X direction.

Upon insertion of the projection portion 35C of the first insulator 35 into the recessed portion 36B of the second insulator 36, the elastic piece 39D of the second communication portion 39F of the second contact member 39 is pressed and elastically deformed by the first communication portion 38K of the first contact member 38, so that the first communication portion 38K and the second communication portion 39F make elastic contact with each other via the elastic piece 39D in the X direction.

Attachment of the connector 31 to the connection object C is performed in the same manner as the connector 11 of Embodiment 1. In other words, after the plurality of first contact members 38 are retained in the plurality of retaining grooves 35F of the first insulator 35, and the plurality of second contact members 39 are retained in the plurality of retaining grooves 36D of the second insulator 36, the pair of projection portions 35C of the first insulator 35 are sequentially passed through the opening portion 14A of the tab sheet 14 shown in FIG. 11 and the opening portion C3 of the connection object C shown in FIG. 16 from the +Z direction, and are separately inserted into the pair of recessed portions 36B of the second insulator 36. At this time, each of the +X directional edge and the −X directional edge of the opening portion C3 of the connection object C enters between the corresponding projection portion 35C of the first insulator 35 and the corresponding recessed portion 36B of the second insulator 36 while being pushed and bent in the +Z direction by the corresponding projection portion 35C of the first insulator 35.

Figure 44:
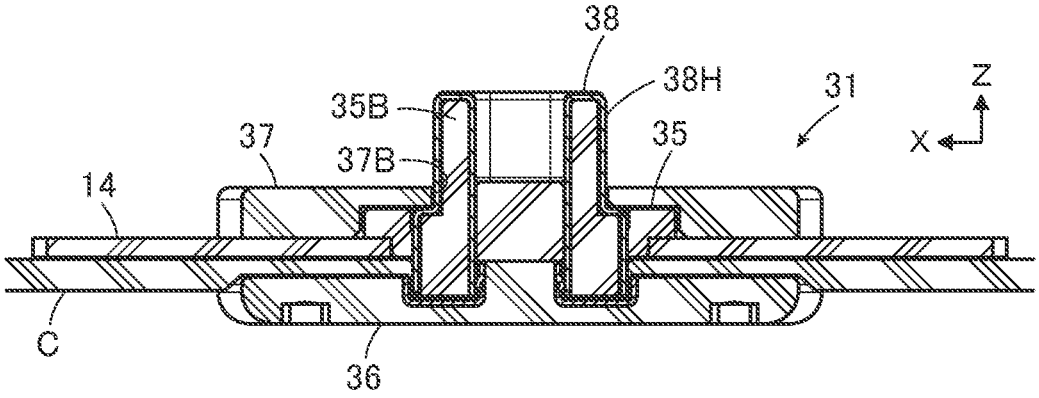
FIG. 44 is a cross-sectional view taken along line C-C in FIG. 34.

Further, the protruding portion 35B of the first insulator 35 is inserted into the opening portion 37B of the third insulator 37, and the plurality of fixing posts 37C of the third insulator 37 are sequentially inserted into the plurality of through-holes 14B of the tab sheet 14, the plurality of through-holes C4 of the connection object C and the plurality of through-holes 36C of the second insulator 36, and −Z directional ends, which project on the −Z direction side of the second insulator 36, of the plurality of fixing posts 37C of the third insulator 37 are heated and deformed, whereby the connector 31 is attached to the connection object C as shown in FIG. 44.

The connection object C is, along with the tab sheet 14, sandwiched in the Z direction between the second insulator 36 and the third insulator 37, and the protruding portion 35B of the first insulator 35 protrudes from the opening portion 37B of the third insulator 37 in the +Z direction, and the contact portions 38H of the plurality of first contact members 38 retained by the first insulator 35 are exposed on the +Z direction side of the connector 31.

Figure 45:
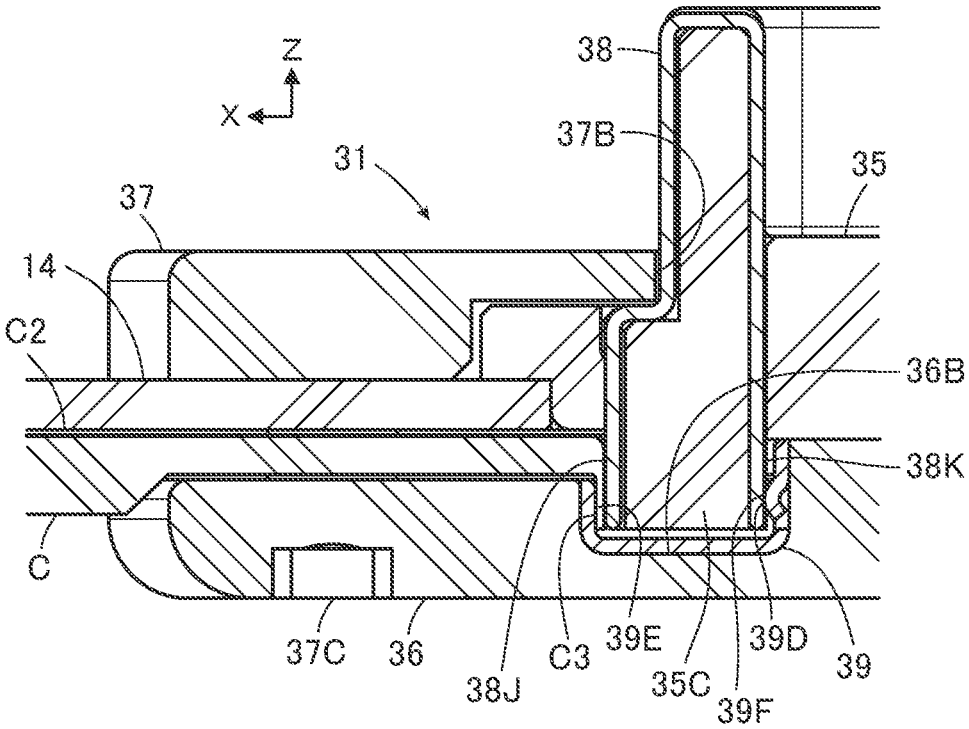
FIG. 45 is an enlarged view of an important part of FIG. 44.
Figure 46:
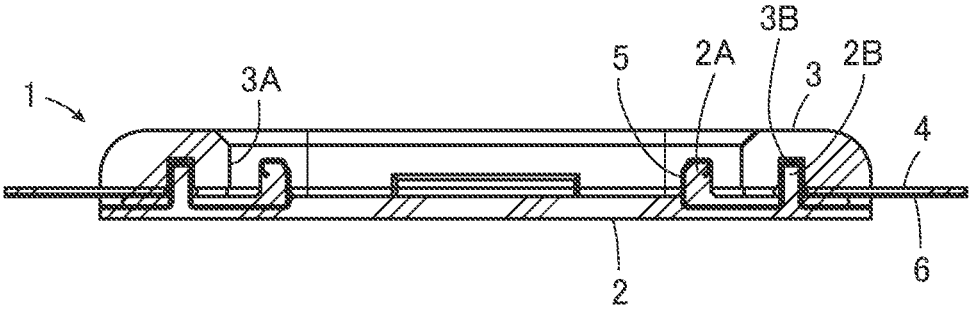
FIG. 46 PRIOR ART
FIG. 46 is a cross-sectional view showing a conventional connector.
Figure 47:
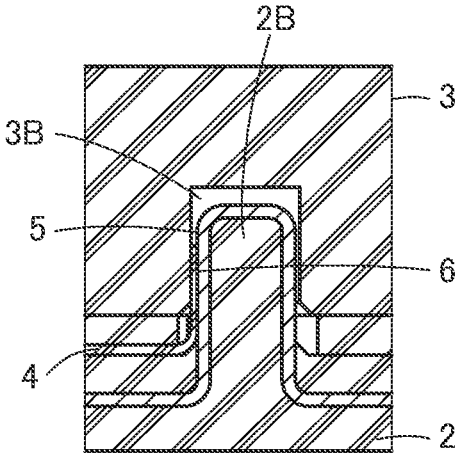
FIG. 47 PRIOR ART
FIG. 47 is an enlarged view of an important part of FIG. 46.

As shown in FIG. 45, the first connection portion 38J and the first communication portion 38K of the first contact member 38 are separately disposed on a pair of outer surfaces, which face in opposite directions to each other, of the projection portion 35C of the first insulator 35, and the second connection portion 39E and the second communication portion 39F of the second contact member 39 are separately disposed on a pair of inner surfaces, which face each other in the X direction, of the recessed portion 36B of the second insulator 36.

Upon insertion of the projection portion 35C of the first insulator 35 into the recessed portion 36B of the second insulator 36, the elastic piece 39D of the second communication portion 39F of the second contact member 39 is pressed and elastically deformed by the first communication portion 38K of the first contact member 38, so that the first communication portion 38K and the second communication portion 39F make elastic contact with each other via the elastic piece 39D to thereby be electrically connected to each other.

Further, upon insertion of the projection portion 35C of the first insulator 35 into the recessed portion 36B of the second insulator 36, the +X directional edge and the −X directional edge of the opening portion C3 of the connection object C are each sandwiched between the first connection portion 38J of the first contact member 38 retained by the first insulator 35 and the second connection portion 39E of the second contact member 39 retained by the second insulator 36.

The connection object C is compressed in the thickness direction thereof, i.e., the X direction between the first connection portion 38J of the first contact member 38 and the second connection portion 39E of the second contact member 39, the first connection portion 38J of the first contact member 38 comes into contact with the top surface of the connection object C, and the second connection portion 39E of the second contact member 39 comes into contact with the bottom surface of the connection object C. Since the flexible conductor C2 is exposed on the top surface of the connection object C, the first connection portion 38J of the first contact member 38 is electrically connected to the flexible conductor C2 of the connection object C. In other words, the contact 33 composed of the first contact member 38 and the second contact member 39 is electrically connected to the flexible conductor C2 of the connection object C.

Thus, also in the connector 31 of Embodiment 3 having the first contact member 38 shown in FIGS. 40 and 41 and the second contact member 39 shown in FIGS. 42 and 43, the first connection portion 38J of the first contact member 38 comes into contact with the top surface of the connection object C, and at the same time, the second connection portion 39E of the second contact member 39 comes into contact with the bottom surface of the connection object C. Therefore, as with the connector 11 of Embodiment 1, the contact 33 can be electrically connected to the flexible conductor C2 of the connection object C regardless of whether the flexible conductor C2 is exposed on the top surface, the bottom surface, or both surfaces of the connection object C.

When the second insulator 36 is assembled to the first insulator 35 in the Z direction which is the predetermined assembling direction D1, the elastic piece 39D of the second contact member 39 elastically deforms, whereby the first communication portion 38K of the first contact member 38 and the second communication portion 39F of the second contact member 39 make elastic contact with each other in the X direction. Thus, since the direction in which the first communication portion 38K and the second communication portion 39F are in elastic contact with each other is orthogonal to the predetermined assembling direction D1, the second insulator 36 assembled to the first insulator 35 is prevented from being detached from the first insulator 35 by an elastic force of the elastic piece 39D, and accordingly, the connector 31 can be maintained in a stable state. While the direction in which the first communication portion 38K and the second communication portion 39F are in elastic contact with each other does not necessarily need to be orthogonal to the predetermined assembling direction D1, the direction preferably intersects the predetermined assembling direction D1.

While in Embodiment 3 mentioned above, the second communication portion 39F of the second contact member 39 includes the elastic piece 39D, even when the first communication portion 38K of the first contact member 38 instead of the second communication portion 39F of the second contact member 39 includes the elastic member 39D, the first communication portion 38K and the second communication portion 39F likewise make elastic contact with each other via the elastic piece 39D, whereby the first contact member 38 and the second contact member 39 can be electrically connected to each other.

While in Embodiments 1 to 3 described above, the plurality of contacts 13, 23, 33 are aligned in two lines parallel to each other, the invention is not limited thereto, and the contacts 13, 23, 33 may be aligned in one line. In the invention, the plurality of contacts 13, 23, 33 are not necessarily required, and it suffices if at least one contact 13, 23, 33 is included.

When, in Embodiments 1 to 3, the connector has such a structure that the first insulator 15, 25, 35 and the second insulator 16, 26, 36 are fixed to each other without using the third insulator 17, 27, 37, the third insulator 17, 27, 37 can be omitted.

While a garment provided with smart textile is described as an example of the connection object C to which the connector 11, 21, 31 is attached, a so-called flexible substrate in which a flexible conductor is disposed on a surface of an insulating substrate can also be used as the connection object C.

While in Embodiments 1 to 3, the connector 11, 21, 31 is attached to the connection object C together with the tab sheet 14 for reinforcing the connection object C, the tab sheet 14 may be omitted when it is not necessary to reinforce the connection object C.

What is claimed is:

1. A connector attached to a connection object having a flexible conductor exposed on at least one of surfaces of the connection object, the connector comprising:

a first insulator;

a second insulator assembled to the first insulator in a predetermined assembling direction, and at least one contact made of a conductive material, wherein the contact is composed of a first contact member retained by the first insulator and a second contact member retained by the second insulator, the first contact member includes a contact portion that makes contact with a contact of a counter connector, a first connection portion that makes contact with one of the surfaces of the connection object, and a first communication portion connected to the second contact member, the second contact member includes a second connection portion that makes contact with the other of the surfaces of the connection object, and a second communication portion facing the first communication portion and connected to the first contact member, the connection object is sandwiched between the first connection portion and the second connection portion, one of the first communication portion and the second communication portion includes an elastic piece protruding to the other of the first communication portion and the second communication portion, the first communication portion and the second communication portion are in elastic contact with and thereby electrically connected to each other via the elastic piece at a position different from a place where the connection object is sandwiched between the first connection portion and the second connection portion, and at least one of the first connection portion and the second connection portion makes contact with the flexible conductor of the connection object, whereby the contact is electrically connected to the flexible conductor of the connection object.

2. The connector according to claim 1, wherein one of the first insulator and the second insulator includes a projection portion projecting in the predetermined assembling direction, and the other of the first insulator and the second insulator includes a recessed portion recessed in the predetermined assembling direction, the connection object is sandwiched between the first insulator and the second insulator, and the projection portion is accommodated in the recessed portion, whereby the second insulator is assembled to the first insulator, and the first communication portion and the second communication portion are in elastic contact with each other via the elastic piece in a direction intersecting the predetermined assembling direction.

3. The connector according to claim 2, wherein the first connection portion and the first communication portion are disposed side by side in the predetermined assembling direction, and the second connection portion and the second communication portion are disposed side by side in the predetermined assembling direction.

4. The connector according to claim 3, wherein the first insulator includes the recessed portion, the first connection portion and the first communication portion are disposed on an inner surface of the recessed portion, the inner surface extending in the predetermined assembling direction, the second insulator includes the projection portion, and the second connection portion and the second communication portion are disposed on an outer surface of the projection portion, the outer surface extending in the predetermined assembling direction.

5. The connector according to claim 2, wherein the first connection portion and the first communication portion are disposed to be apart from each other in a direction intersecting the predetermined assembling direction, and the second connection portion and the second communication portion are disposed to be apart from each other in a direction intersecting the predetermined assembling direction.

6. The connector according to claim 5, wherein the first insulator includes the recessed portion, the first connection portion and the first communication portion are separately disposed on a pair of inner surfaces of the recessed portion, the pair of inner surfaces facing each other, the second insulator includes the projection portion, and the second connection portion and the second communication portion are separately disposed on a pair of outer surfaces of the projection portion, the pair of outer surfaces facing in opposite directions to each other.

7. The connector according to claim 5, wherein the first insulator includes the projection portion, the first connection portion and the first communication portion are separately disposed on a pair of outer surfaces of the projection portion, the pair of outer surfaces facing in opposite directions to each other, the second insulator includes the recessed portion, and the second connection portion and the second communication portion are separately disposed on a pair of inner surfaces of the recessed portion, the pair of inner surfaces facing each other.

8. The connector according to claim 4, wherein when the projection portion is accommodated in the recessed portion, part of the connection object is bent in the predetermined assembling direction by the projection portion and sandwiched between the first connection portion and the second connection portion.

9. The connector according to claim 1, wherein the first contact member and the second contact member are apart from each other by a predetermined gap around the elastic piece.

10. The connector according to claim 1, further comprising a third insulator for fixing the second insulator to the first insulator.

* * * * *